US005335001A

United States Patent [19]

Katano

[11] Patent Number: 5,335,001

[45] Date of Patent: * Aug. 2, 1994

[54] PROCESS AND APPARATUS FOR FORMING DOT IMAGE CAPABLE OF CONTROLLING DOT SIZE

[75] Inventor: Yasuo Katano, Yokohama, Japan

[73] Assignee: Ricoh Company, Ltd., Tokyo, Japan

[ * ] Notice: The portion of the term of this patent subsequent to Jan. 11, 2011 has been disclaimed.

[21] Appl. No.: 681,069

[22] Filed: Apr. 5, 1991

[30] Foreign Application Priority Data

Apr. 9, 1990 [JP] Japan ..... 2-94811
Apr. 20, 1990 [JP] Japan ..... 2-104609

[51] Int. Cl.[5] ..... B41M 5/28

[52] U.S. Cl. ..... 346/76 R; 346/135.1; 346/76 PH; 347/17; 347/101

[58] Field of Search ..... 346/1.1, 135.1, 76 R, 346/76 PH

[56] References Cited

U.S. PATENT DOCUMENTS 4,838,940 6/1989 Kan et al. ..... 346/76 R
4,920,361 4/1990 Arahara et al. ..... 346/76 R
4,962,389 10/1990 Kan et al. ..... 346/76 R

FOREIGN PATENT DOCUMENTS 40-18992 8/1965 Japan .
40-18993 8/1965 Japan .
44-09512 5/1969 Japan .
54-41902 12/1979 Japan .
63-264392 11/1988 Japan .

OTHER PUBLICATIONS

Japanese Journal of Polymer Science and Technology, vol. 37, No. 4, pp. 287-291, Apr. 1980, K. Ronbunshu.

*Primary Examiner*—Benjamin R. Fuller
*Assistant Examiner*—Huan Tran
*Attorney, Agent, or Firm*—Oblon, Spivak, McClelland, Maier & Neustadt

[57] ABSTRACT

A process for forming a dot image on a recording medium which has a surface having a characteristic in which a receding contact angle decreases when the recording medium is heated in a condition where the recording medium is in contact with a liquid. The process includes in an arbitrary order the following steps (a) and (b) of: (a) selectively heating the surface of the recording medium so that one or a plurality of heated areas are formed on the surface of the recording medium in accordance with image information, the size of each heated area being controlled in accordance with the image information; and (b) bringing a liquid to the surface of the recording medium, wherein the receding contact angle of each heated area decreases so that a latent image corresponding to one or the plurality of the heated areas is formed on the surface of the recording medium. An apparatus for forming a dot image operates in accordance with the above process.

45 Claims, 19 Drawing Sheets

PROCESS AND APPARATUS FOR FORMING DOT IMAGE CAPABLE OF CONTROLLING DOT SIZE

BACKGROUND OF THE INVENTION

The present invention relates to a process and an apparatus for forming a dot image on a recording medium capable of controlling dot size, and particularly to a process and an apparatus for forming a dot image on a recording medium capable of controlling dot size which can be used for a formation of a gradational image. The recording medium used in the present invention has a characteristic in which a receding contact angle decreases when the recording medium is heated in a condition where the recording medium is in contact with a contact material such as a liquid or the like.

An offset printing method using a printing plates without water (water for moisturizing) is a typical one of methods in which a recording medium is divided into areas where it is easy for liquid to adhere thereto and area where it is hard for the liquid to adhere thereto. However, in this offset printing method, it is difficult to incorporate a process for manufacturing printing plates from original plates and a process for printing from the printing plates into a single apparatus. This makes it difficult to have a compact printing apparatus.

For example, even in a case of relatively compact offset printing apparatus, a plate making apparatus and a printing apparatus are separated.

To eliminate this fault of the offset printing method, there has been proposed a recording method and apparatus in which areas where it is easy for the liquid to adhere thereto and areas where it is hard for the liquid to adhere thereto can be formed in accordance with image information and in which the recording medium can be repeatedly used (a process for forming an image is reversible). The following are some of these.

(1) Water-soluble developing method

After a charge has been applied from an external device to a hydrophobic photo-electric layer, a medium having the hydrophobic photo-electric layer is exposed so that a pattern having hydrophobic portions and hydrophilic portions is formed on the surface of the hydrophobic photo-electric layer. Then, a water soluble developing solution adheres to only the hydrophilic portions and is transferred to a paper or the like. Such methods and apparatus are disclosed in Japanese Patent Publication Nos.40-18992, 40-18993 and 44-9512 and Japanese Patent Laid Open Publication No.63-264392, etc.).

(2) Method using a photo-chemical response of a photo-chromic material

In this method, an ultraviolet light is irradiated to a layer which contains a material such as a spiropyran or an azo dye so that a photo-chemical reaction occurs to make the photo-chromic material hydrophilic. Such method and apparatus are described in "Japanese Journal of Polymer Science and Technology" Vol. 37, No. 4 page 287, 1980).

(3) Method using an action of an internal biasing forces

In this method, amorphous substances and crystalline substances are formed in a recording medium by a physical transformation, so that portions where it is easy for a liquid ink to adhere thereto and portions where it is hard for the liquid ink to adhere thereto are formed on the recording medium. An example of such is disclosed in Japanese Patent Laid Open Publication No.54-41902.

According to the previously described method (1), after the water-soluble ink is transferred to the paper or the like, the hydrophilic portions are removed by removing the charge so that it is possible to record other image information. That is, one original plate (photoelectric member) can be repeatedly used for printing images. However, in this method, an electrophotography process is basically used, so that a long time is required for carrying out the process involving steps of charging, exposing, developing, transferring and discharging. Therefore, it is difficult to make an apparatus compact, to reduce its cost and to make an apparatus in which it is unnecessary to maintain.

In the method (2) described above, it is possible to freely control the reversibility of the hydrophilic and hydrophobic properties by selective irradiation of ultraviolet and visible light. However, since a quantum efficiency is very small, a response time is extremely long and a recording speed is low. In addition, there is also a fault of image instability. Therefore, this method has still not put into practical use.

Furthermore, an information recording member (the recording medium) which is used in the method (3) has stability after an image is formed thereon, but there are occasions structural transformation occurs in the information recording member due to temperature changes prior to the recording. That is, the method (3) has a disadvantage in that it is difficult to maintain the image on the information recording member. In addition, when recorded information patterns is removed, a thermal pulse must apply to the information recording member and then it is, necessary to rapidly cool the information recording member. Therefore, it is difficult to perform frequent repetition of image formation.

SUMMARY OF THE PRESENT INVENTION

Accordingly, a general object of the present invention is to provide a novel and useful process for forming a variable sized dot image.

A more specific object of the present invention is to provide a process and an apparatus for forming a dot image which can easily make a latent image corresponding to a gradational visible image form on a recording medium having a surface for which the receding contact angle decreases when the surface of the recording medium is heated in a condition where a liquid is in contact therewith.

The above objects of the present invention are achieved by a process for forming a dot image on a recording medium which has a surface having a characteristic in which a receding contact angle decreases when the recording medium is heated in a condition where the recording medium is in contact with a liquid, a vapor or a solid which generates or changes to either a vapor or a liquid under condition of a temperature lower than a temperature at which the receding contact angle on the recording medium starts to decrease, the process comprising in an arbitrary order the following steps (a) and (b) of: (a) selectively heating the surface of the recording medium so that one or a plurality of heated areas are formed on the surface of the recording medium in accordance with image information, the size of each heated area being controlled in accordance with the image information; and (b) bringing a contact material into contact with the surface of the recording medium, the contact material being either a liquid, a vapor or a solid which generates or changes to either a vapor or a liquid under condition of a temperature lower than a temperature at which the receding contact angle on the recording medium starts to decrease, wherein the receding contact angle of each heated area decreases so that a latent image corresponding to one or the plurality of the heated areas is formed on the surface of the recording medium.

The above objects of the present invention are also achieved by a process for forming a dot image on a recording medium which has a surface having a characteristic in which a receding contact angle decreases when the recording medium is heated in a condition where the recording medium is in contact with a liquid, a vapor or a solid which generates or changes to either a vapor or a liquid under condition of a temperature lower than a temperature at which the receding contact angle on the recording medium starts to decrease, the process comprising in an arbitrary order the following steps (a) and (b) of: (a) selectively heating the surface of the recording medium so that one or a plurality of heated areas are formed on the surface of the recording medium in accordance with image information, the temperature of each heated area being controlled in accordance with the image information; and (b) bringing a contact material into contact with the surface of the recording medium, the contact material being either a liquid, a vapor or a solid which generates or changes to either a vapor or a liquid under condition of a temperature lower than a temperature at which the receding contact angle on the recording medium starts to decrease, wherein the receding contact angle of each heated area decreases and corresponds to the temperature thereof so that a latent image corresponding to one or the plurality of the heated areas is formed on the surface of the recording medium.

The above objects of the present invention are also achieved by an apparatus for recording an image comprising: a recording medium which has a surface having a characteristic in which a receding contact angle decreases when the recording medium is heated in a condition where the recording medium is in contact with a liquid, a vapor or a solid which generates or changes to either a vapor or a liquid under condition of a temperature lower than a temperature at which the receding contact angle on the recording medium starts to decrease; heating means for heating the surface of the recording medium; controlling means for controlling the amount of heat supplied from the heating means to the surface of the recording means in accordance with image information; and first supplying means, coupled to the recording medium, for supplying a contact material to the surface of the recording medium, the contact material being selected from a liquid, a vapor and a solid which generates or changes to either a vapor or a liquid under a condition of a temperature lower than a temperature at which the receding contact angle on the recording medium starts to decrease, wherein the receding angle of a liquid adhesive area on the surface of the recording medium decreases, the liquid adhesive area being an area to which the heat from the heating means is supplied in a condition where the contact material is in contact with the surface of the recording medium, so that a latent image corresponding to the liquid adhesive area is formed on the surface of the recording medium.

The above objects of the present invention are also achieved by an apparatus for recording an image comprising: a recording medium which has a surface having a characteristic in which a receding contact angle decreases when the recording medium is heated in a condition where the recording medium is in contact with a liquid, a vapor or a solid which generates or changes to either a vapor or a liquid under condition of a temperature lower than a temperature at which the receding contact angle on the recording medium starts to decrease; heating means for heating the surface of the recording medium; controlling means for controlling the size of an area to which the heating means supplies the heat in accordance with image information; and first supplying means, coupled to the recording medium, for supplying a contact material to the surface of the recording medium, the contact material being selected from a liquid, a vapor and a solid which generates or changes to either a vapor or a liquid under a condition of a temperature lower than a temperature at which the receding contact angle on the recording medium starts to decrease, wherein the receding angle of a liquid adhesive area on the surface of the recording medium decreases, the liquid adhesive area being the area to which the heat from the heating means is supplied in a condition where the contact material is in contact with the surface of the recording medium, so that a latent image corresponding to the liquid adhesive area is formed on the surface of the recording medium.

Another object of the present invention is to provide a process and a apparatus for controlling the size of each dot in a dot image which can make a clear gradational image formed on either on the recording medium or a recording sheet.

A further object of the present invention is to provide a process and an apparatus for controlling the size of each dot in a dot image in which a step of forming a latent image, a developing step for forming a gradational visible image on the recording medium and a transferring step for transferring the gradational visible image to a recording sheet can be stably sequentially carried out.

The above objects of the present invention are achieved by a process for forming a dot image on a recording medium which has a surface having a characteristic in which a receding contact angle decreases when the recording medium is heated in a condition where the recording medium is in contact with a liquid, a vapor or a solid which generates or changes to either a vapor or a liquid under condition of a temperature lower than a temperature at which the receding contact angle on the recording medium starts to decrease, the process comprising in an arbitrary order the following steps (a) and (b) of: (a) selectively heating the surface of the recording medium so that one or a plurality of heated areas are formed on the surface of the recording medium in accordance with image information, the size of each heated area being controlled in accordance with the image information; and (b) bringing a recording agent which includes a colorant into contact with the surface of the recording medium, wherein the receding contact angle of each heated area decreases and the recording agent adheres to the heated areas, the amount of the recording agent adhering to each heated area corresponding to the size of each corresponding heated area, so that a gradational visible image is formed on the surface of the recording medium.

The above objects of the present invention are also achieved by a process for forming a dot image on a recording medium which has a surface having a characteristic in which a receding contact angle decreases when the recording medium is heated in a condition where the recording medium is in contact with a liquid, a vapor or a solid which generates or changes to either a vapor or a liquid under condition of a temperature lower than a temperature at which the receding contact angle on the recording medium starts to decrease, the process comprising in an arbitrary order the following steps (a) and (b) of: (a) selectively heating the surface of the recording medium so that one or a plurality of heated areas are formed on the surface of the recording medium in accordance with image information, the temperature of each heated area being controlled in accordance with the image information; and (b) bringing a recording agent which includes a colorant into contact with the surface of the recording medium, wherein the receding contact angle of each heated area decreases and corresponds to the temperature thereof and the recording agent adheres to the heated areas, the amount of the recording agent adhering to each heated area corresponding to the the temperature of each corresponding heated area, so that a gradational visible image is formed on the surface of the recording medium.

The above objects of the present invention are achieved by an apparatus for recording an image comprising: a recording medium which has a surface having a characteristic in which a receding contact angle decreases when the recording medium is heated in a condition where the recording medium is in contact with a liquid, a vapor or a solid which generates or changes to either a vapor or a liquid under condition of a temperature lower than a temperature at which the receding contact angle on the recording medium starts to decrease; heating means for heating the surface of the recording medium; controlling means for controlling the amount of heat supplied from the heating means to the surface of the recording means in accordance with image information; and supplying means, coupled to the recording medium, for supplying a recording agent which includes a colorant to the surface of the recording medium, wherein the receding contact angle of a liquid adhesive area decreases and the recording agent adheres to the liquid adhesive area, the liquid adhesive area being an area to which the heat from the heating means is supplied in a condition where recording agent is in contact with the surface of the recording medium, the amount of the recording agent adhering to the liquid adhesive area corresponding to the heat supplied from the heating means to the surface of the recording medium, so that a gradational visible image is formed on the surface of the recording medium.

The above objects of the present invention are also achieved by an apparatus for recording an image comprising: a recording medium which has a surface having a characteristic in which a receding contact angle decreases when the recording medium is heated in a condition where the recording medium is in contact with a liquid, a vapor or a solid which generates or changes to either a vapor or a liquid under condition of a temperature lower than a temperature at which the receding contact angle on the recording medium starts to decrease; heating means for heating the surface of the recording medium; controlling means for controlling the size of an area to which the heating means supplies the heat in accordance with image information; and supplying means, coupled to the recording medium, for supplying a recording agent which includes a colorant to the surface of the recording medium, wherein the receding contact angle of a liquid adhesive area decreases and the recording agent adheres to the liquid adhesive area, the liquid adhesive area being an area to which the heat from the heating means is supplied in a condition where recording agent is in contact with the surface of the recording medium, the amount of the recording agent adhering to the liquid adhesive area corresponding to the size of the liquid adhesive area to which the heating means supplies the heat, so that a gradational visible image is formed on the surface of the recording medium.

Additional objects, features and advantages of the present invention will become apparent from the following detailed description when read in conjunction with the accompanying drawings.

DETAILED DESCRIPTION OF THE INVENTION

Figure 1A:
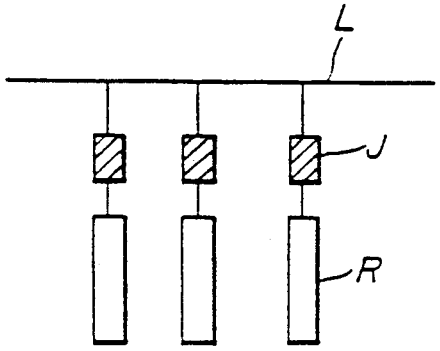
FIGS. 1A through 1D are views indicating models of the structure of a material having a surface sulf-orientation function.

The inventors of the present invention carried out much research and investigation regarding a novel recording method in which the faults described for the conventional technologies had been eliminated. As a result of this, the inventors discovered that a member having the following characteristics is effective as a recording medium.

When an area on the surface of the member is heated in a condition of being in contact with the liquid and then cooled, a receding angle of the area becomes smaller. After that, when the area is heated in a condition in which the liquid has been removed, the receding angle of the area becomes larger and returns to an original value. The receding angle of the area can be controlled in accordance with a temperature of the heated area.

One of the members having the above characteristic is a first member (1) in which the surface portion thereof includes an organic compound having a surface self orientation function with a hydrophobic group, or a second member (2) in which the surface portion thereof is an organic compound having the hydrophobic group which is oriented to the surface.

The "surface self orientation function" in the first member (1) is defined as a function whereby the hydrophobic group at the surface is oriented towards the side of the air (i.e. the side with the free surface) when a solid comprising a base member and an organic compound formed on the base member or a solid organic compound is heated in the air. This definition is also used for the second member (2). In general, an organic compound offers a phenomena in which a hydrophobic group is easily oriented towards the side of a hydrophobic atmosphere. As the orientation is towards the side at which the interfacial energy of the solid-gas boundary decreases, the above phenomena occurs. In addition, this phenomena is remarkable for the longer the molecular chains of the hydrophobic group, because the larger the molecular chain the mobility of the molecule becomes larger.

More specifically, in a case of a molecule which has a hydrophobic group at an end thereof (i.e. a molecule in which the surface energy is low), the hydrophobic group is easily oriented in a direction of the side of the air (i.e. the side with the free surface). In the same manner, in a case of chain molecules which include $$\leftarrow CH_2 \rightarrow_n, \quad \leftarrow CH_2 \rightarrow_n$$

portions are flat and easily oriented. In addition, in molecules which include

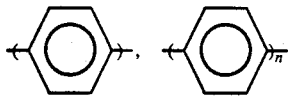

portions also have a flat structure and are easily oriented. Especially, the chain molecules including a chemical element in which an electronegativity is large, such as a fluoride, have a large self aggregation. In the chain molecules, a mutual molecular chains are easily oriented.

To summarize the results of these investigations, in a chain molecule which includes a molecule having a large self aggregation or a molecule having a flat structure and has the hydrophobic group at an end thereof, or in an organic compound including the above chain molecule, the surface self orientation function is large.

As is clear from the preceding discussion, there is a relationship between the surface self orientation and the receding contact angle. In addition, there is also a relationship between the receding contact angle and the liquid adhesiveness. That is, the adhesion of the liquid to the surface of the solid mainly occurs due to a tacking force for tacking the liquid at the surface of the solid. The tacking force can be regard as a type of friction which is generated when the liquid slides against the surface of the solid. Thus, in this invention, the "receding contact angle" $\theta_r$ can be denoted by the following formula.

$$\cos\theta_r = \gamma \cdot (\gamma_s - \gamma_{sl} - \pi_e + \gamma_f)/\gamma_{lv}$$

where:

$\gamma$: surface tension of a solid in a vacuum $\gamma_{sl}$: surface tension at the solid-liquid interface $\gamma_{lv}$: surface tension of the liquid in a condition in which the liquid is in contact with a saturated vapor $\pi_f$: equilibrium surface tension $\gamma_f$: friction force $\gamma_s$: surface tension of a solid without an absorption layer The above formula is disclosed by Saito, Kitazaki et al, "Japan Contact Adhesive Association Magazine" Vol. 22, No. 12, No. 1986.

According to the above formula, when the receding contact angle $\theta_r$ decrease, the friction force $\gamma_f$ increases. That is, when the receding contact angle increases, it becomes hard for the liquid to slip on the surface of the solid. As a result, the liquid is adhered to the surface of the solid.

As can be assumed from the above mutual relationships, the adhesiveness of the liquid depends on the receding angle $\theta_r$. This receding angle $\theta_r$ depends on types of materials which have the surface self orientation function at the surface thereof. Hence, in the present invention, it is necessary to forming a predetermined pattern area on the recording medium (A) and/or to make a visible image corresponding to the pattern area by a recording agent, so that a member in which the surface thereof has the surface self orientation function is selected as the recording medium (A).

The recording medium (A) used in the present invention has a surface in which the receding contact angle $\theta_r$ decreases when the surface is in contact with the liquid in a condition of heating it. In addition, the receding contact angle $\theta_r$ is changed in accordance with the temperature of the heated area. When the receding contact angle is changed, the adhesiveness of the liquid at the area is changed. That is, dot size of an image is controlled by change of the receding contact angle. Thus, a gradational image can be formed on the recording medium (A). The gradational image formed on the recording medium (A) can be also transferred to a recording sheet.

The recording medium (A) can be of any shapes as long as the surface thereof has the nature described above. Thus, the recording medium (A) can be of a film shape. The recording medium (A) can also have a structure in which a coating film or the like having the nature described above is provided on the surface of a supporting member. The recording medium (A) can be structured by only one member in which the surface thereof has the nature described above.

An area where it is easy for the liquid to adhere thereto, which area is formed on the recording medium (A), becomes either a lipophilic area or a hydrophilic area in accordance with the type of contact material (B). Thus, either oil-soluble ink or water-soluble ink is used for printing an image.

FIGS. 1A through 1D indicate a classification of the types of materials or portions of materials "having a surface for which the receding contact angle $\theta_r$ decreases when the material is heated and brought into contact with a liquid". FIG. 1A indicates an example of a compound having a self-orientation function. This compound has a hydrophobic group on the side chains of the macromolecule polymer. The main chain L and the hydrophobic group R are linked by a linking group J.

Figure 1B:
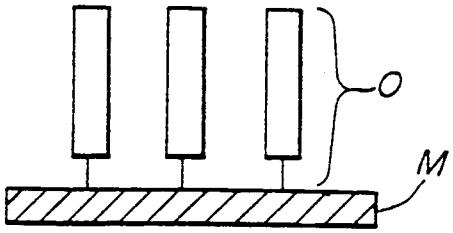
Figure 1C:
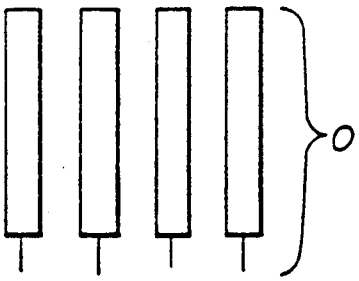

FIG. 1B indicates an example of a material in which the hydrophobic group in an organic compound are oriented towards the surface thereof. The compound O having the previously described hydrophobic group is formed by the physical or chemical linking to the surface of an organic or inorganic material M. FIG. 1C shows an example of a material which is made up of only the organic compound O having the hydrophobic group indicated in FIG. 1B.

Figure 1D:
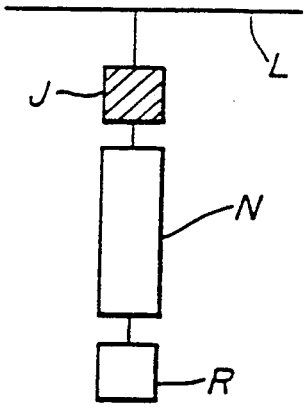

FIG. 1D indicates an example where the chain molecules are in a side chain of a macromolecule. The chain molecules and the main chain L are linked by the linking chain J. This is a compound in which each chain molecule has a molecular chain N having either a flat structure of a self-aggregation and the hydrophobic group R is linked at an end of the molecular chain N.

In the examples shown in FIGS. 1A and 1D, the main chain L of the macromolecule compound can either have a linear shape or a network structure.

In the example indicated in FIG. 1B, as in a case of a deposited Lngmuir-Blodgett film, it is also possible to use a compound O including a hydrophobic group and then deposit a compound O including a hydrophobic group on another one. In the example indicated in FIG. 1C, there is only a compound including a hydrophobic group, with there being no main chain L and no linking to an organic or inorganic material (M) or the like.

The previously described hydrophobic group should desirably have the end molecules as $-CH_3$, $-CF_3$, $-CF_2H$, $-CFH_2$, $-C(CF_3)_3$, $-C(CH_3)_3$ or the like. More desirably however, it is advantageous if this hydrophobic group has long molecules which have a high molecular mobility. Of these, the previously described hydrophobic group can be an alkyl group in which either a fluorine or a chlorine is substituted for at least one hydrogen thereof, which alkyl group has more than one —F and/or —Cl, such as $$-CF_2CF_2\underset{\underset{Cl}{|}}{C}FCF_2CF_2.$$

The above hydrophobic group can also be an alkyl group having a carbon number of 4 or more. An alkyl group in which either a fluorine (F) or a chlorine (Cl) substituted for at least one hydrogen thereof can be used and it is more effective if an alkyl group in which a fluorine is substituted for at least one hydrogen thereof is used. It is further more effective that a compound has the polymer whose side chain includes fluorine.

The principle of this function is not yet perfectly understood but is assumed to be as described below.

First, it will be considered that the surface of a recording medium (A) formed by this compound described above has a surface on which the hydrophobic group is considerably oriented. Thus, this surface has a liquid repellency property (since the surface energy of the hydrophobic group is the smaller). In this state, when the surface of the recording medium (A) and the contact material (B) are brought into contact and heated, the heating causes the molecular motion of the hydrophobic group to increase and the recording medium (A) and the contact material (B) are interacted with each other. Thus, an orientation state of at least one portion of the recording medium (A) changes into another one (for example, the orientation is disordered). Then the changed state is maintained after the recording medium (A) is cooled. Even if the contact material (B) is either a vapor or a solid before heating, the contact material (B) in contact with the recording medium (A) becomes liquid in the state in which the recording medium (A) is being heated.

Prior to heating, because the hydrophobic group is oriented in the surface of the recording medium (A), the surface energy of the recording medium (A) is extremely low. However, by heating the recording medium (A) in the state where the contact material (B) is in contact therewith, the orientation is disordered and the surface energy increases. The receding contact angle $\theta_r$ is determined by the balance between the surface energy of the solid and surface energy of the liquid. If the surface energy of the solid is high, then irrespective of the type of liquid, the receding contact angle $\theta_r$ will become smaller. Thus, the adhesiveness with respect to the liquid will increase as a result.

Furthermore, after the orientation state in the surface of the recording medium (A) changes into another orientation state or a state in which the orientation is disordered, when the recording medium (A) is heated in a condition where there is no contact material (B), the interaction between the recording medium (A) and the contact material (B) does not occur, so that the recording medium (A) reverses to the former orientation state.

Accordingly, the contact material (B) is not one where it simply performs cooling after the surface of the recording medium (A) has been heated, but is one where there is some kind of the recording medium (A) for the change of state (either a state where there is an orientation different from the former orientation state or a state where the orientation has been disordered) to occur.

As has been described above, when the hydrophobic group of a member (compound) forming the surface of the recording medium (A) is an alkyl, an alkyl group in which either a fluorine or a chlorine is substituted for at least one hydrogen thereof, then it is necessary for the carbon number of the alkyl to be 4 or more. This carbon number which is 4 or more is thought to be the necessary number for active molecule motion when heating is performed, and for a certain degree of orientation of the alkyl on the surface of the recording medium (A). In addition, when the contact material (B) is heated along with the surface of the recording medium (A), it is thought that the molecules of the contact material (B) are incorporated into the molecules of the surface of the recording medium (A). Furthermore, an alkyl group including fluorine or chlorine which has a high electronegativity is used, then there is a large interaction with liquid and particularly liquids having polarity and so there is a larger change in the adhesiveness than in the case of a compound that includes an alkyl group in which there are not fluorine and chlorine. In addition, the alkyl group which includes fluorine has a strong self-aggregation and so the surface self-orientation function is also high. Still furthermore, the alkyl group which includes fluorine has a low surface energy and so have an excellent effect in prevention the surface of the recording medium (A) from being dirtied.

Moreover, the surface of the recording medium (A) has a liquid repellency effect. This may be described in terms of the surface energy of a solid. In the course of the investigation performed by the inventors, it was found that it is desirable as far as use for a recording method is concerned, for this surface energy to be 50 dyn/cm or less. When the surface energy of the recording medium (A) is greater than 50 dyn/cm, the surface of the recording medium is easily wet and it is possible to become dirty with the recording agent.

A detailed description will now be given of a compound forming the surface of the recording medium (A).

A compound in which an alkyl group (which can include fluorine and/or chlorine) is included in the side chain of a polymer can be preferred as the type of compound as shown in FIG. 1A or 1D. More specifically, monomers indicated in (I), (II), (III), (IV), (V), (VI) and (VII) are preferred.

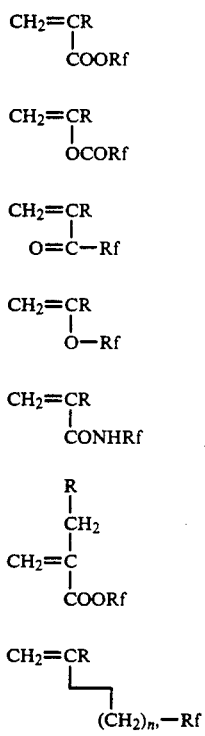

(I) (II) (III) (IV) (V) (VI) (VII)

R is either —H, $—CH_3$, $—C_2H_5$, $—CF_3$ or $—C_2O_5$.

Rf is either an alkyl group having a carbon number of 4 or more, a group including an alkyl group in which either a fluorine or a chlorine is substituted for at least one hydrogen thereof, or a hydrophobic group in which

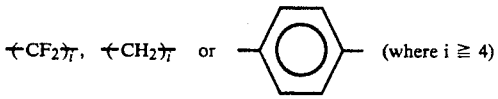

(where i ≧ 4)

n′ is an integer and equal to or greater than 1.

Other polymers are those indicated in (VIII), (IX), (X).

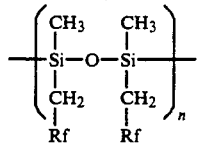

(VIII)

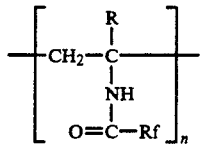

(IX)

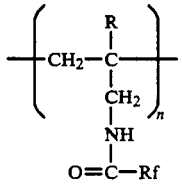

(X)

R is either —H, $—CH_3$, $—C_2H_5$, $—CF_3$ or $—C_2O_5$.

Rf is either an alkyl group having a carbon number of 4 or more, a group including an alkyl group in which either a fluorine or a chlorine is substituted for at least one hydrogen thereof, or a hydrophobic group in which

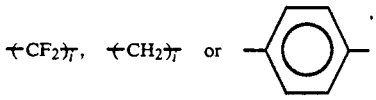

is provided in the molecule chain (where i≧4).

n is an integer and equal to or greater than 10.

In these (I) through, Rf can be as indicated in to the following (1) through (20).

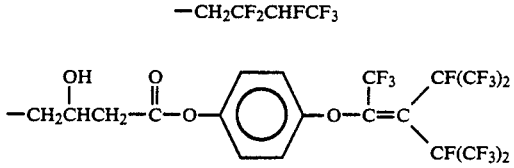

$—CH_2CF_2CHFCF_3$ (1)

(2)

$—CH_2CH_2OC(=O)—C_7F_{15}$ (3)

(4)

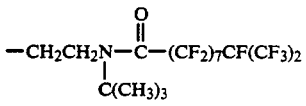

$—CH_2CHCH_2(CF_2)_4CF_3$ (5)

$—CH_2(CF_2)_{10}H$ (6)

$+CF_2\rangle_6O—CF_2CF_3$ (7)

$+CH_2\rangle_4NH—CF_2CF_3$ (8)

$+CF_2\rangle_6CF_3$ (9)

$+CH_2)_{10}C_8F_{17}$ (10)

-continued $$-CH_2N(C_2H_5)-SO_2C_8F_{17} \quad (11)$$

$$-(CH_2)_{10}N(CH_3)SO_2C_8F_{17} \quad (12)$$

$$-CH_2NHSO_2C_8F_{17} \quad (13)$$

(14)

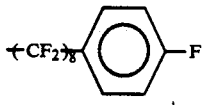

$$c.s-CH_2CH_2-(CF_3)_6CF(CF_3)_2 \quad (15)$$

$$-CH_2CF_2CF_2CF_3 \quad (16)$$

$$-CH_2CH_2CH_2CH_2F \quad (17)$$

$$-CH_2(CF_2)_6CF_3 \quad (18)$$

$$-CH_2(CF_2)_5CF_3 \quad (19)$$

$$-(CH_2)_3CF_3 \quad (20)$$

The following material (XI) can be selected from particular consideration from the above compounds.

$$H_2C=CH-C(=O)-O-R^2-(CF_2)_mCF_3 \quad (XI)$$

where $R^1$ is either hydrogen, $-C_nH_{2n+1}$ or $-C_nF_{2n+1}$ (n is an integer, $n=1$ or $n \geqq 2$), $R^2$ is either $-(CH_2)_p$ (where p is an integer, $p \geqq 1$) or $-(CH_2)_qN(R^3)SO_2-$ (where $R^3$ is either $-CH_3$ or $C_2H_5$, q is an integer, $q \geqq 1$), and m is an integer equal to or greater than 6.

Accordingly, the following compounds are given as the most desirable compound for use as the member for the surface of the recording medium (A) of the present invention.

$$CH_2=C(CH_3)-COO-(CH_2)_7H \qquad CH_2=C(CH_3)-COO-(CH_2)_5H$$

$$CH_2=CH-COO-(CH_2)_2-(CF_2)_6Cl$$

$$CH_2=CH-COO-(CH_2)_2-(CF_2)_8F$$

$$CH_2=CH-COO-(CH_2)_2-(CF_2)_6F$$

$$CH_2=C(CH_3)-COO-(CH_2)_2-(CF_2)_6F$$

-continued $$CH_2=C(CH_3)-COO-(CH_2)_2-(CF_2)_6F$$

$$CH_2=CH-COO-(CH_2)_2N(C_2H_5)-SO_2-(CF_2)_6F$$

$$CH_2=CH-COO-(CH_2)_2-(CF_2)_9F$$

$$CH_2=C(CH_3)-COO-(CH_2)_2-(CF_2)_{10}-F$$

$$CH_2=CH-COO-CH_2CF_2CHFCF_3$$

$$CH_2=C(CH_3)-COO-(CH_2)_2-(CF_2)_9F$$

$$CH_2=CH-COOCH_2CH_2OC(=O)-(CF_2)_7F$$

$$CH_2=C(CH_3)-COOCH_2(CF_2)_7CF_3$$

$$CH_2=CH-COOCH_2(CF_2)_7CF_3 \qquad CH_2=C(CH_3)-COOCH_2(CF_2)_9CF_3$$

$$CH_2=CH-COOCH_2(CF_2)_9CF_3$$

Moreover, a copolymer made of some of monomers indicated in (I) (II) (III) (IV) (V) (VI) (VII) and (XI) and other monomers such as ethylene, vinyl chloride, styrene, butadien, isoprene, chloroprene, vinyl alkyl ether, vinyl acetate and vinyl alcohol can be also used as the compound forming the surface of the recording medium (A).

In addition, a copolymer is made of a monomer represented by the formula (XI) and at least one of the following monomers each having a functional group.

$$CH_2=C(CH_3)COO(CH_2)_2OH$$

$$CH_2=C(CH_3)COOCH_2CH(OH)CH_3$$

$$CH_2=CHCOOCH_2CH(OH)C_8F_{17}$$

As a result, many functional groups are formed in the copolymer. In this manner, the manufactured substance has excellent properties as crosslinking type of polymer. Either formaldehyde, dialdehyde, N-Methylol compounds, dicarboxylic acid, dicarboxylic acid chloride, bis-halogen compounds, bis epoxide, bis aziridine, diisocyanate and the like can be used as the crosslinking agent. The following is one example of a crosslinking polymer obtained in this manner.

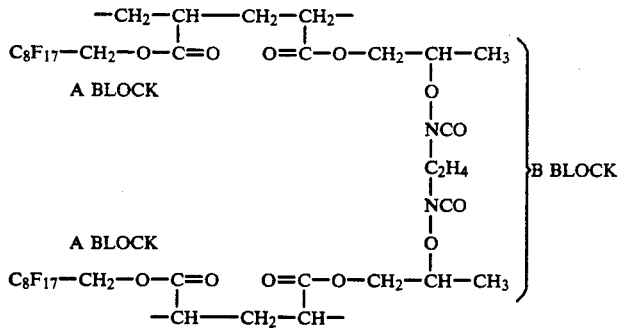

In the above formula, the A block is an alkyl group which brings on the previously described change in the thermal nature. The B block is the agent that crosslinks property of chain polymers (with diisocyanate being used as the crosslinking agent).

A liquid in which the above described copolymer and the crossliking agent are mixed is coated on a substrate, and then either heating or irradiating electrons or light with respect to the substrate coated the liquid, so that a crosslinked film is formed on the substrate.

The process for obtaining the polymer from the monomer is selected in accordance with materials from solution polymerization, electrolysis polymerization, emulsification polymerization, photo polymerization, radiation polymerization, plasma polymerization, graft polymerization, plasma-iniciated polymerization, vapor deposition polymerization and the like.

A description will now be given of the compound indicated in FIG. 1B.

It is desirable that One of the following materials indicated by (XII), (XIII) and (XIV) be used for making the compound.

$R_f$—COOH (XII)

$R_f$—OH (XIII)

$R_f$—$(CH_2)_n$SiX (XIV)

where, $R_f$ is either an alkyl group in which a carbon number is 4 or more, a group including an alkyl group in which fluoride or chloride is substituted for at least one hydrogen thereof, a hydrophobic group in which —$(CF_2)_l$, —$(CH_2)_l$ or—is included in the molecular chain (where $l \geqq 4$), m is an integer equal to or greater than 1, and X is either chlorine, methoxy group or ethoxy group.

On the above materials is physically absorbed or chemically connected to the surface of an inorganic material such as gold or copper or an inorganic material such as polyester or polyethylenterephthalate (and preferably the material has a surface energy of approximately 50 dyn/cm or less).

The following are specific examples of the materials in formula (XII), (XIII) and (XV).

$CF_3$—$(CF_2)_5$—COOH $CF_3$—$(CF_2)_7$—COOH $CF_3$—$(CF_2)_7$—$(CH_2)_2$—OH

H—$(CF_2)_{10}$—COOH

H—$(CF_2)_{10}$—$CH_2OH$

F—$(CF_2)_6$—$CH_2CH_2$—$Si(CH_3)_2Cl$ $CF_2Cl(CF_3)CF(CF_2)_5COOH$ $CF_3(CF_2)_7(CH_2)_2SiCl_3$

The compound indicated in FIG. 1C can have a structure where there is only the material of (XII), (XIII) or (XIV).

A description will now be given of the recording medium (A) formed of the above compound.

The configuration of the recording medium (A) is such that it is (1) formed by the previously described surface member itself, or (2) formed by the previously described surface member on a supporting member (preferably a supporting member having heat resistance). The above compound (surface member) which applies to (1) above have either a plate or film shape, or can also be formed as a cylinder. In this case, it is desirable for a film shape to have a film thickness of between 1 um and 5 μm.

In a case of the compound pertaining to (2) above, it is permitted for the above described compound to permeate some distance into the supporting member. It is desirable that the film thickness of the recording medium (A) itself be from 30 Å to 1 μm. With respect to the thermal conductivity, a film thickness of between 100 Å and 10 um is better, and with respect to the friction resistance, a film thickness of 10 μm to 1 mm is better. It is desirable that the heat resist temperature of the supporting member be between 50° C. and 300° C.

The shape of the supporting member can also be a belt shape, a plate shape or a drum shape. The shape of the supporting member can be selected in accordance with the usage of an image forming apparatus. In particular, drum shapes have the advantage of being able to ensure good dimesional accuracy. In a case of plate shapes, the size of the plate is determined in accordance with the size of the recording sheet to be used.

Moreover, when a mixture made of the above compound (material formed on the surface of the recording medium (A)) and other material, such as hydrophobic polymer or hydrophobic inorganic material is formed on the supporting member, there is the advantage of preventing dirtying of a background of the image at printing. In addition, in order to raise the thermoconductivity, metal powder or the like can be mixed in the above described compound. Furthermore, in order to increase the adhesiveness between the supporting member and the above described compound, a primer layer can be provided between the supporting member and the compound. The thermal resistance supporting member can be formed of a resin film, such as a polyimide film, a polyester film or the like, a glass, a metal such as Ni, Al, Cu, Cr, Pt or the like, or a metallic oxide. The surface of the supporting member can be smooth, rough or porous.

A description will now be given of the contact material (B).

The contact material (B) has been described above. The contact material (B) is either a liquid or a vapor from its initial state, or a solid which ultimately becomes a liquid at a temperature less than a temperature at which the receding angle $\theta_r$ of the recording medium (A) starts-to decrease. Then, a liquid obtained by a condensation of the vapor wets the surface of the recording medium (A). At a temperature equal to or less than the temperature at which the receding contact angle $\theta_r$ starts to decrease, the solid changes into a liquid, generates a liquid, or generates a vapor. A liquid is obtained by the condensation of the vapor generated from the solid, and then the liquid wets the surface of the recording medium (A).

The contact material (B) is selected, for example, one of the following material.

In a case of the liquid, the contact material (B) is, in addition to the water, a water soluble liquid including electrolytes, n-butanol and other alcohols, glycerine, ethylene glycol and other multivalent alcohols, a liquid having polarity such as methyl ethyl ketone and other ketones, n-nonan, n-octane and liquids not having polarity such as other chain hydrocarbons, cyclohexane and other circular hydrocarbons, meta-xylene, benzene or other aromatic hydrocarbons. In addition, a substance which is mixture of the above materials is also suitable. Various types of dispersed liquids and liquid inks can also be used. The liquid having polarity are more suitable.

In a case of the vapor, the contact material (B) can be, in addition to the water, a vapor of the above material, particularly ethanol vapor and meta-xylene vapor and other vapors of organic compounds (including those that are mist state) can be used. A temperature of the vapors of organic compounds must be less than a melting point or a softening temperature of the compound which forms the surface of the recording medium.

In a case of the solid, the contact material (B) can be high-class fatty acids, low molecular weight polyethylene, macromolecules gel (poly acryl amido gel, poly vinyl alcohol gel), sillica gel, or hydrated compound.

As will be described later, when the contact material (B) is a "recording agent which contains a colorant" such as the above described liquid inks, the formation of the latent image and the developing of the image are performed simultaneously.

A description will now be given of heating means.

The heating means can be a heater, a thermal head or another type of contact heating device, but can also be a non-contact type of heating device which uses electromagnetic radiation (such as a laser light, infra-red radiation lamps or some of type of light which is irradiated from a light source and focussed through a lens system). In addition, electron beam irradiation or ultraviolet light irradiation can also achieve the process of the present invention if the recording medium (A) can be effectively heated.

Figure 2A:
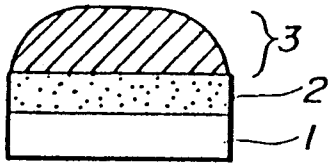
FIGS. 2A, 2B, 3A, 3B and 3C are views for describing the fundamental aspects of the image recording process according to the present invention.
Figure 2B:
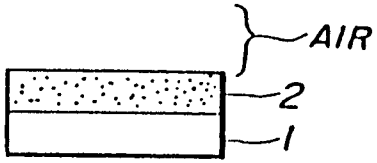

In FIG. 2A, a film 2 of the above described compound is formed on a substrate 1 so as to form the surface of the recording medium (A), and a liquid 3 of the contact material (B) exists on the film 2. In this state, when the film is heated, the receding contact angle $\theta_r$ on the surface of the film 2 decreases so that wetting appears on the surface of the film 2. That is, on the surface of the film, the adhesion of the liquid is recognized. In addition, when the film 2 having the adhesion of the liquid is heated again in a vacuum or in an atmosphere of an inert gas (FIG. 2B), the receding contact angle $\theta_r$ increases and then the water repellency can be recognized on the surface of the film 2.

A phenomena similar to the above phenomena is disclosed in Japanese Patent Publication No. 54-41902, described above. However, this disclosed process differs from the process of the present invention in that the recording material is effectively disordered and in that the mechanism obtains a layer of an amorphas memory substance. That is, in the present invention, it is not possible to have a change in the state of the surface of the recording medium (A) without the contact material (B). In addition, in the process disclosed in Japanese Patent Publication No.54-41902, it is not possible to obtain the reversible change by a simple operation.

Figure 3A:
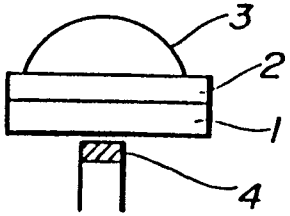

As shown in FIG. 3A, when the film 2 is heated in accordance with a image information signal in a condition in which the liquid 3 is in contact with the surface of the film 2, the adhesion property of the liquid is obtained on a portion, which is heated, of the film 2. In a case where the liquid 3 is brought into contact with the surface of the film after the film 2 is heated in accordance with the image information signal in a state where there is no liquid, as shown in FIG. 3B, the same result as the case shown in FIG. 3A is obtained.

Figure 3B:
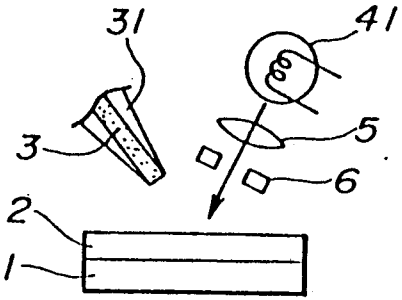

In FIGS. 3A and 3B, a heater 4 turns on and off in accordance with the image information signal, The liquid 3 is supplied from a liquid supply opening 31 to the surface of the film 2. Heat radiation from an infrared heater 41 is irradiated to the film 2 via a lens 5 and shutter 6.

Figure 3C:
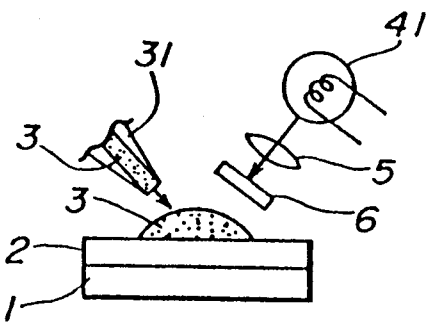

The shutter 6 turns on and off in accordance with the image information signal. FIG. 3A indicates an example where the heating of the film 2 is performed through the substrate 1. In an example indicated in FIG. 3C, the heating of the film 2 is performed through the liquid 3.

Figure 4:
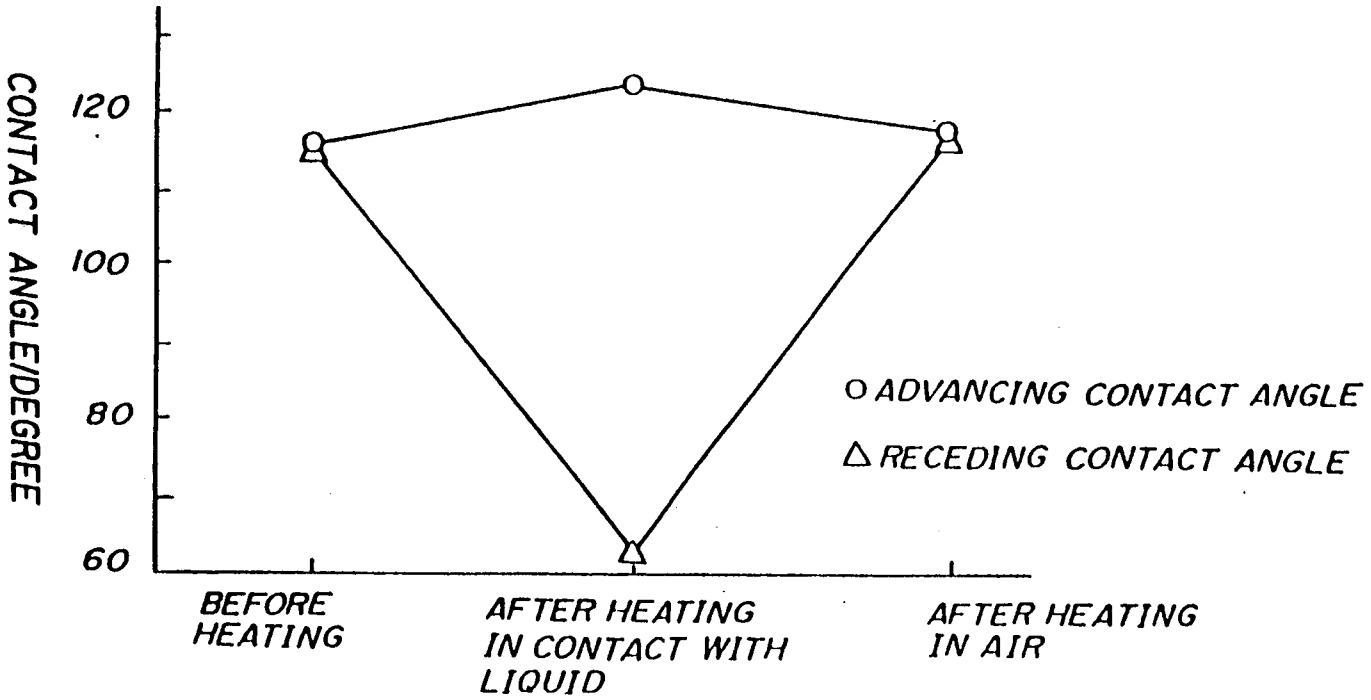
FIG. 4 is a graph indicating the changes in the advancing contact angle and the receding contact angle in the surface of the recording medium.

FIG. 4 is a graph illustrating contact angles of a water-soluble liquid on the film 2 prior to heating the film 2 and after heating film 2 in a condition where the water-soluble liquid is in contact with the film 2. FIG. 4 is also illustrates contact angles of the water-soluble liquid when the film 2 is further heated in air. In FIG. 4, ○ denotes the advancing contact angle, and Δ denotes the receding contact angle.

In general, when the receding contact angle is a high value equal to or greater than 90, the surface of the substance exhibits liquid repellency. When the receding contact angle is a low value less than 90°, the surface of the substance exhibits liquid adhesion.

In a state where the contact material (B) is contact with the recording medium (A), the recording medium (A) should be heated at a temperature between 50° C. and 250° C., but preferably should be heated at a temperature between 80° C. and 150° C. The heating time should be in the range of 0.5 msec to 1 sec., but preferably should be in the range of 0.5 msec to 2 msec. The heating timing is determined as follows. In a case of forming a latent image, (1) when the surface of the recording medium (A) is heated, and then the temperature of the recording medium is not less than a predetermined temperature, the contact material (B) is brought into contact with the recording medium (A). (2) In a state where the contact material (B) is in contact with the surface of the recording medium (A) (the liquid is in contact with the surface of the recording medium), the surface of the recording medium (A) is heated. Either the above (1) or (2) can be carried out. In a case of erasing the latent image, the recording medium (A) should be heated at a temperature between 50° C. and 300° C., but preferably should be heated at a temperature between 100° C. and 180° C. The heating time should be in a range of 1 msec. to 10 sec, but preferably should be in a range of 10 msec. to 1 sec.

A detailed description will now be given of means for recording image information on the surface of the recording medium (A).

Figure 5A:
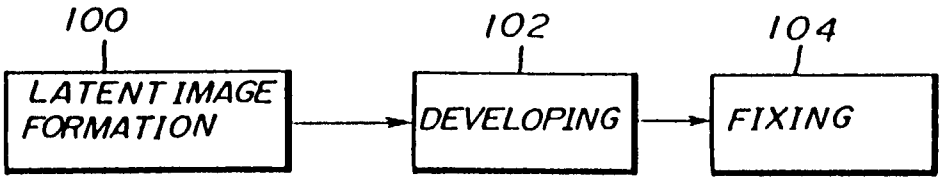
FIGS. 5A, 5B and 5C are block diagrams illustrating recording processes according to the present invention.

As shown in FIG. 5A, the surface of the recording medium (A) is heated in accordance with a image information signal in a condition where a liquid is provided on the surface of the recording medium (A) or in a vapor atmosphere, and thus liquid adhesion areas are formed on the surface of the recording medium (A) (latent image formation step 100). After this, a recording agent is brought into contact with the surface of the recording medium (A) so that the recording agent adheres to the latent image portion (developing step 102). Then, the image formed by the recording agent is fixed on the surface of the recording medium (A) (fixing step 104). The above process for recording the image is often referred to as a direct recording process.

Figure 5B:
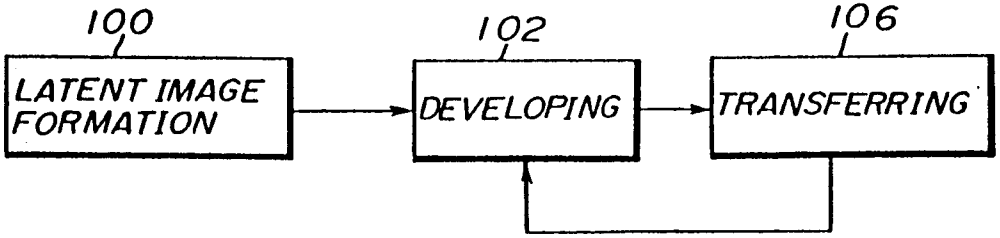
Figure 5C:
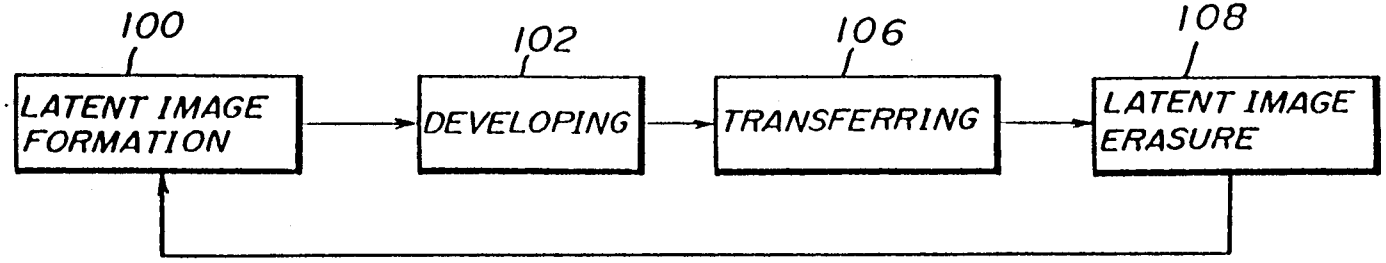

As shown in FIG. 5B, the surface of the recording medium (A) is heated in accordance with the image information signal in the condition where the liquid is in contact with the surface of the recording medium (A) or in the vapor atmosphere, and thus liquid adhesion areas are formed on the surface of the recording medium (A) (latent image formation step 100). After this, the recording agent is brought into contact with the surface of the recording medium (A) so that the recording agent adheres to the latent image portion (developing step 102). Then, the image formed by the recording agent is transferred to a recording sheet (transferring step 106). This process for recording image on the recording sheet is often referred to as an indirect recording process. Furthermore, if the step where the recording agent is brought into contact with the latent image portion on the surface of the recording medium (A) and the step where the image formed by the recording agent is transferred to the recording sheet are sequentially repeatedly carried out, the images are successively formed on the recording sheets. That is, a printing process in which the recording medium (A) is used as a printing plate is obtained.

As shown in FIG. C, after the latent image formation step 100, the developing step 102 and the transferring step 106 are sequentilally carried out, the surface of the recording medium (A) is heated without the liquid or the vapor so that the latent image is erased from the surface of the recording medium (A). That is, an image forming process in which it is possible to repeatedly form different latent image on the surface of the recording medium (A). This process for repeatedly forming the image on the recording medium (A) is referred to as a repeat recording process.

A description will now be given of an apparatus for recording an image in accordance with the above described process.

If the recording medium (A) has the surface on which the receding contact angle decreases when the liquid is brought into contact with the surface and the surface is heated, the recording medium (A) can have any shape. The surface having the above characteristic will be hereinafter termed the "film 2" or the "surface of the recording medium (A)". The recording medium (A) can be either a rigid cylindrical shape or a flexible film shape. A recording medium with a rigid cylindrical shape (i.e. the film 2 is formed on the surface of the rigid cylinder) can accurately move, so that a position where the image is formed on the surface of the recording medium (A) is accurately controlled. Thus, it is desirably that the rigid cylinder be used as the recording medium. This recording medium (A) is manufactured by forming the film 2 on a substrate. A formed member of a material which has the above described characteristic can even be the recording medium (A) itself. In particular, as the formed member is generally mechanically weak, it is desirably that the film 2 be formed on the substrate. Even in a case where the formed member is used as the recording medium (A), the film 2 forms the surface of the formed member.

In a case where the substrate of the recording medium (A) is formed of resin, as the substrate has a poor heat conductivity, a time required for heating the surface of the recording medium is heated and obtaining the adhesive of the liquid is relatively long. Therefore, a good heat conductor is used for either all or a part of the substrate.

Figure 6B:
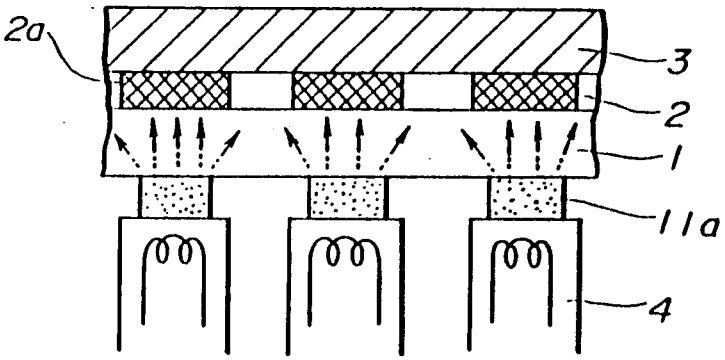
FIGS. 6A through 14 are views illustrating examples of an apparatus for forming the image in accordance with the recording process.
Figure 6A:
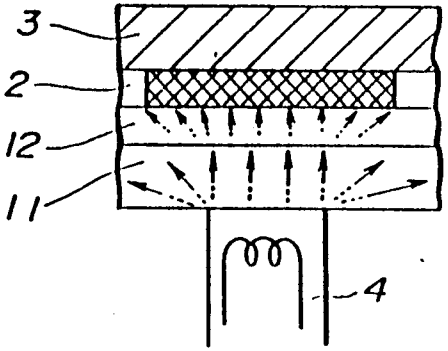

In FIG. 6A, a good heat conductor such as a metal is used as the substrate (metal substrate 11). An organic thin film 12 is formed on the metal substrate 11 by vapor evaporation, and the film is formed on the organic thin film 12. Due to this stacked structure, it is possible to improve a speed of thermal conductivity in the vertical direction. The organic thin film 12 is, for example, made of polyimide, polyester, phtalocyanine or the like. This structure is thought to be sufficient in a case where the printing dots are relatively large. However, this mechanism shown in FIG. 6A is not suitable for rapidly printing a dot image since an area having liquid adhesive enlarges by the dispersion of the heat, supplied from the heater 4, in directions parallel to the surface of the film 2. A structure shown in FIG. 6B prevents the heat provided from each heater 4 from dispersing in the directions parallel to the surface of the film 2, so that each area 2*a* having liquid adhesive can be minimized. In FIG. 6B, small metal films 11*a* are formed on a surface of the substrate, which surface is opposite to a surface on which the film 2 is formed. The heat generated by each heater 4 is transmitted via each corresponding metal film 11*a* and the substrate 1 to the film 2.

Next, a description will be give of means for forming a latent image.

As has been described above, the heater source can be a heater, a thermal head or some other types of contact heaters, or a laser light, an infra-red lamp or some other types of non-contact heaters which emit an electromagnetic wave.

The following will be a description of the conceptual sturcture of the mechanism for heating the surface of the recording medium (A) in the state where a liquid is in contact with the surface of the recording medium (A). A type of the recording medium in which the film 2 is formed on a substrate 1 is used in the following mechanisms.

Figure 7A:
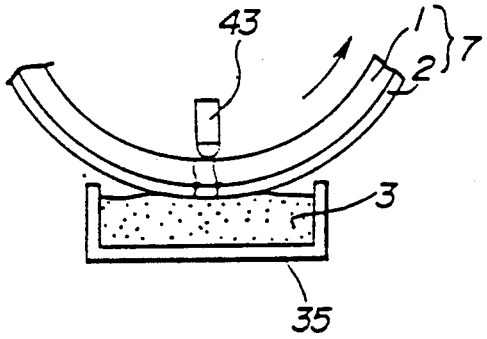
Figure 7B:
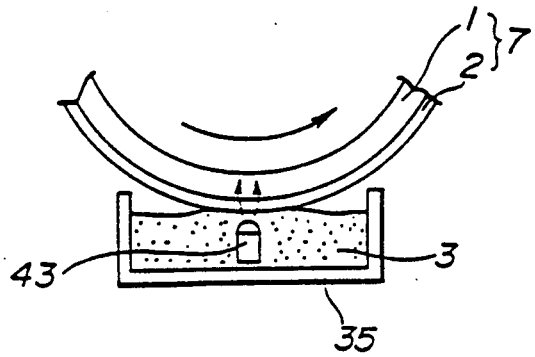
Figure 7C:
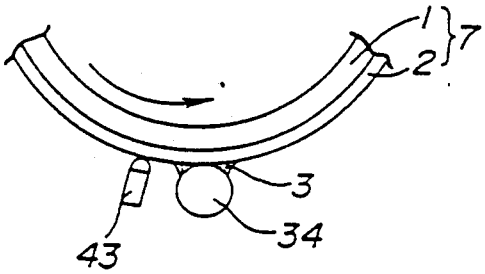
Figure 7D:
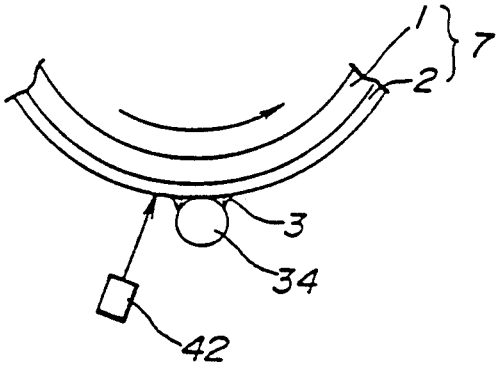

In FIGS. 7A and 7B, a liquid 3 is always in a state of contact with the lower surface of a recording medium 7 which is in a drum shape. Then, in this state, when the recording medium 7 relates, the recording medium 7 is selectively heated in accordance with the image information, from the side of the substrate 1 or the side of the liquid 3. In FIG. 7C, the surface (film 2) of the recording medium 7 is selectively heated in accordance with the image information. Then, immediately after that, the surface of the recording medium 7 is brought into with the liquid 3. In FIG. 7D, the laser beam from a laser light source 42 is used to selectively heat the surface of the recording medium 7.

As shown in FIGS. 7A and 7B, a vat 35 filled with the liquid 3 is provided at the lower portion of the recording medium 7 and the lower surface of the recording medium 7 is always in contact with the liquid 3 in the vat 35. The heat source (a thermal head 43) is mounted in the vat 35 or in the vicinity of the vat 35, so that a structure of this printing mechanism becomes simple. Instead of the vat 35, a sponge type of porous substance 35 filled with the liquid 3 can be provided so that the sponge type of porous substance 35 is in contact with the surface of the recoridng medium 7. In addition, it is also possible to heat the surface of the recording medium 7 by an electron beam.

As has been described above, the surface of the recording medium 7 is heated and liquid 3 is brought into contact with the surface of the recording medium 7 so that each area with liquid adhesive has a small receding contact angle $\theta_r$ and latent image in accordance with areas with liquid adhesive are formed.

Figure 8:
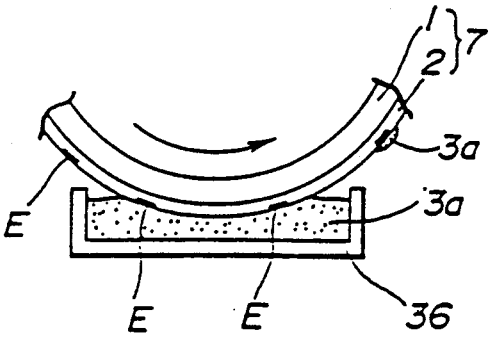
Figure 9:
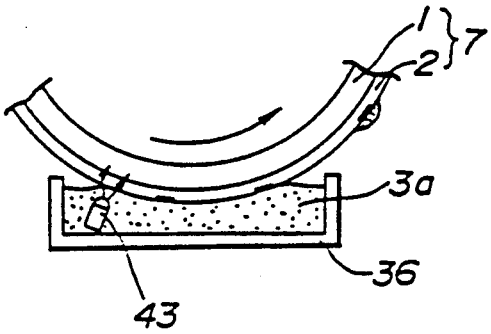

A recording agent (ink) is adhered to each liquid adhesive area selectively formed on the surface of the recording medium 7 in accordance with the image information. A mechanism for adhering the recording agent to each liquid adhesive area has, as shown in FIG. 8, a vat 36 filled with the recording agent 3a. The vat 36 is arranged on a down stream side of the mechanism for forming the latent image in a moving direction of the recording medium 7 so that the recording agent 3a is always in contact with the surface of the recording medium 7. In this mechanism, when the recording medium 7 rotates, the liquid recording agent 3a is adhered to the liquid adhesive area (latent image) E formed as described above. This recording agent 3a which adheres to the surface of the recording medium 7 forms a visible image. In FIG. 9, the liquid recording agent 3a is filled in the vat 36 and is in a state where the surface of the recording medium 7 is always in contact with it. Then, the thermal head 43 selectively heats the surface of the recording medium 7 from the side of the recording agent 3a. In the mechanism shown in FIG. 9, as the recording agent 3a has a function for forming latent image and a function for developing the latent image, the latent image is formed and then the latent image is developed in one process. The printing apparatus having the mechanism shown in FIG. 9 can be made compact.

Figure 10:
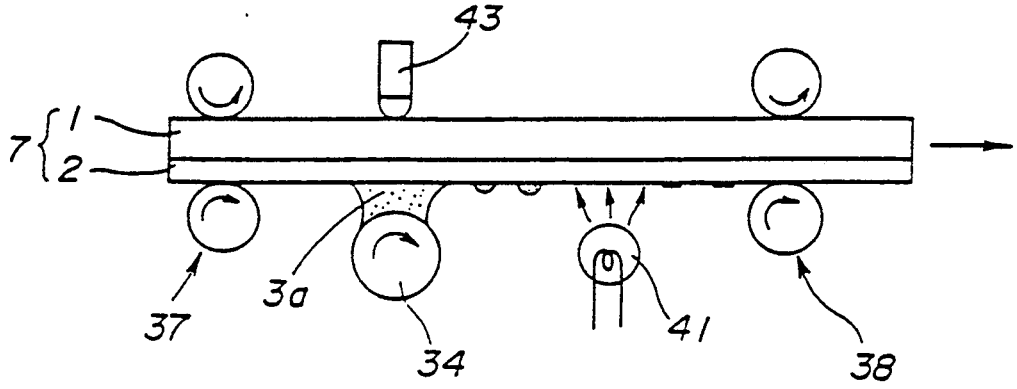

FIG. 10 illustrates an example of the direct formation of a visible image on the surface of the recording medium 7.

Referring to FIG. 10, a flexible film or a rigid film is used as the substrate 1. A stacked structure consisting of the substrate 1 and the film 1 is uses as the recording medium 7. The recording medium 7 is conveyed at a constant speed by rollers 37 and 38. A porous roller 34 into which the recording agent 3a has been impregnated is in contact with the surface of the recording medium (i.e. the film 2). The surface of the substrate 1 of the recording medium 7 is selectively heated in accordance with the image information by a thermal head 43. In a state where the recording agent 3a is in contact with the surface of the film 2, the thermal head 43 selectively heats the film 2 via the substrate 1, so that the latent image is formed on the surface of the film 2 and then the latent image is developed by the recording agent 3a. After that, recording agent 3a (the latent image) adhered to the surface of the film 2 is heated and dried by an infra-red heater 41. The recording agent 3a is fixed on the surface of the film 2 due to the heating and the drying. Therefore, a visible image 3b is formed on the film 2 of the recording medium 7.

Figure 11:
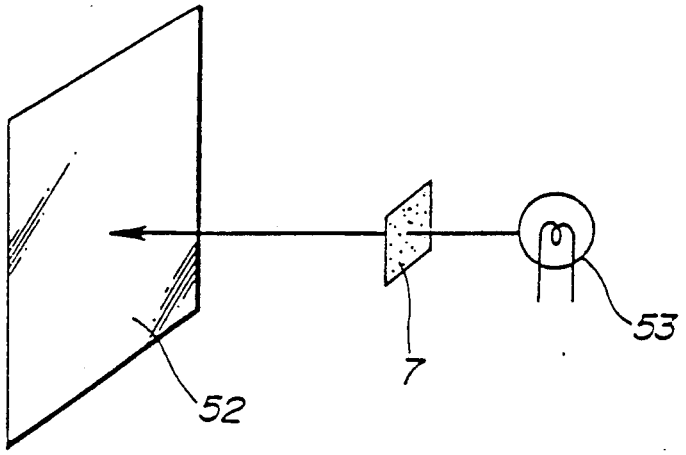
Figure 12:
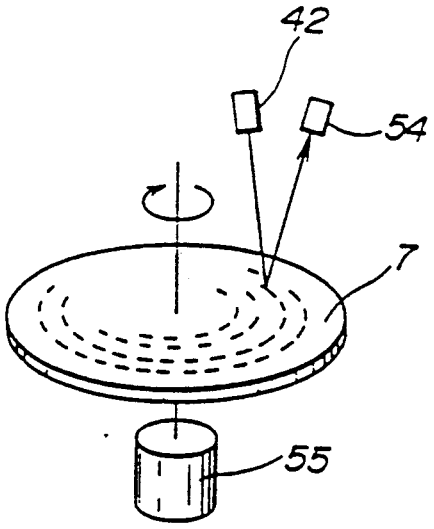

A transparent film can be used as the recording medium. In this case, the transparent film on which the visible image 3b is formed by the recording agent 3a can be, as shown in FIG. 11, used as a slide for projection. That is, when a light is illuminated from a light source 53 which is placed behind the surface of the transparent film, the image 3b on the transparent film is projected onto a screen 52. In addition, as shown in FIG. 12, it is also possible to use the recording medium as an information storage medium. That is, in a state where a disk type recording medium 7 is rotated at a constant speed by a motor 55, a light beam from a laser light source 42 is irradiated to the recording medium 7. It is possible to read the information by detecting the intensity of the light beam reflected in accordance with the visible image 3b on the surface of the recording medium 7.

Figure 13:
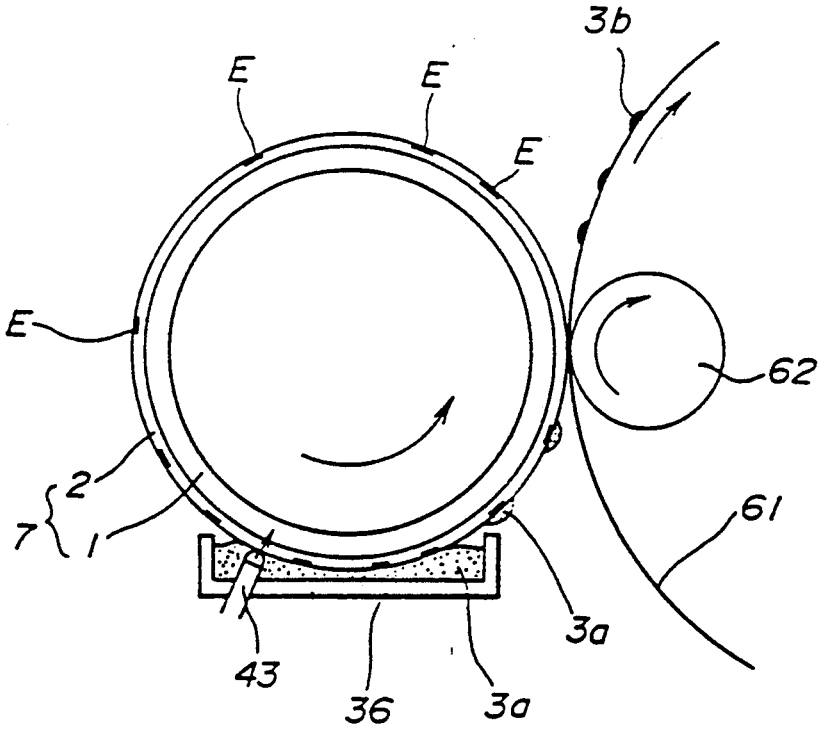
Figure 14:
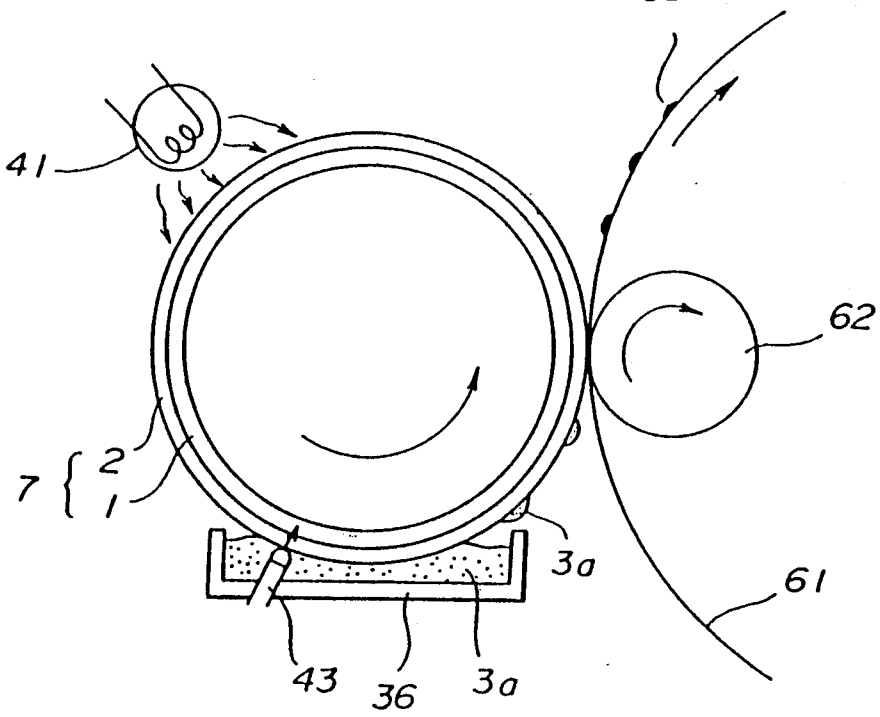

FIGS. 13 and 14 illustrate apparatus having mechanisms for transferring a visible image formed on the recording medium to a recording sheet (the indirect recording process).

In the indirect recording process for transferring a visible image to the recording sheet, it is advantageous to use a rigid cylinder member as the substrate 1.

FIG. 13 illustrate a first printing apparatus. In FIG. 13, the recording agent 3a is filled in the vat 36. In a state where a lower surface of the recording medium 7 is in contact with the recording agent 3a, the recording medium 7 is rotated at a constant speed. A thermal head 43 selectively heats the surface of the recording medium 7 in accordance with the image information. As has been described above, the recording agent 3a adheres to the heated areas of the surface of the recording medium 7 (the film 2). Then, the recording agent 3a adhering to the surface of the recording medium 7 is transferred to the recording sheet 61 fed between the recording medium 7 and a roller 62. The mechanism for transferring the recording agent 3a from the recording medium 7 to the recording sheet 61 is arranged so that the transferring process is carried out after the developing process. It is desirable that the transferring process be carried out immediately after the developing process.

In the printing apparatus shown in FIG. 13, the latent image is not erased from the surface of the recording medium 7, so that the developing process and the transferring process can be repeatedly carried out to enable printing. When the printing of one image has been completed, the exchanging of the recording medium 7 of the latent image erasure enable the printing of a different image.

FIG. 14 illustrates a second recording apparatus in which images can be successively formed. The recording apparatus shown in FIG. 14 has the same mechanisms for forming the latent image, developing the latent image, and transferring the recording agent, as that shown in FIG. 13.

Referring to FIG. 14, after transferring process, in a state where the liquid or the vapor are not present (in air, vacuum or inert gas), an infra-red heater 41 heats the surface of the recording medium 7 on which the latent image is formed. The latent image is erased from the surface of the recording medium 7 due to the heating by the infra-red heater 41. When the latent image is erased from the surface of the recording medium 7, it becomes possible to reuse the recording medium 7 for forming a new image.

In addition, the heating device can be a heater, a thermal head or another contact types of heating devices, but can also be a non-contact type of heating device which use the electromagnetic radiation. The heating can be performed for the entire surface or can be performed only the latent image portion. However, to obtain a compact apparatus, it is desirable that the mechanism for heating the entire surface of the recording medium 7 be provided on the printing apparatus. Moreover, after the surface of the recording medium 7 is heated so as to erase the latent image, the surface of the recording medium 7 is effectively cooled to a normal temperature in a time until the next latent image is formed. The heating temperature which is required for erasing the latent image is determined based on the material of the surface of the recording medium 7. This heating temperature should desirably be a temperature lower than the decomposition point and higher that a temperature at which the receding contact angle starts to decrease of the surface of the recording medium 7. The recording sheet can be a transparent resin film, a plain paper, an ink jet paper, a typing paper or the like.

A description will now be given of the recording agent.

In the recording process for obtaining a visible image on the surface of the recording medium (A) according to the present invention, the recording agent can be ink for writing, ink for ink jet printing, printing ink, electrostatic transfer toner or some other recording agent used in conventional printing processes.

Therefore, in the case of the specific example of water-soluble ink, it is possible to use water-soluble ink containing water, humictants and dye as the main components, water based pigment dispersal inks that have water, pigments macromolecule compounds for dispersal and humictants as the main components, or emulsion inks in which pigments or dyes are the surface activated agents that are dispersed in water. The humictants used in water based inks can be any of the following water-soluble organic compounds:

ethanol, methanol, propanol and other monovalent alcohols;

ethylene glycol, diethylene glycol, triethylene glycol, tetraethylene glycol, polyethylene glycol, propylene glycol, dipropylene glycol, glycerine and other multivalent alcohols;

ethylene glycol monobutyl ether, diethylene glycol monomethyl ether, triethylene glycol monomethyl ether, tetraethylene monomethyl ether, propylene glycol monomethyl ether, ethylene glycol, diethylene glycol monoethyl ether, triethylene glycol monoethyl ether, tetraethylene glycol monoethyl ether, propylene glycol monoethyl ether and other multivalent alcohol ethers;

N-methyl-2-pyrrol idone, 1,3-dimethyl-imidazolricinon, ε-caprolactum and other heterocyclic compounds; and monoethanol amine, diethanoi amine, triethanol amine, monoethyl amine, diethyl amine, trietyl amine and other amines.

The water-soluble pigment can be a pigment which is classified by the color index into acid pigments, direct pigments, chlorine group pigments, responsive pigments and food pigments.

The examples of pigments indicated as follows.

C.I. acid yellow: 17, 23, 42, 79, 142

C.I. acid red: 1, 8, 13, 14, 18, 26, 27, 35, 37, 42, 52, 82, 87, 89, 92, 97, 106, 111, 114, 115, 134, 186, 249, 254, 289

C.I. acid blue: 9, 29, 45, 92, 249, 890

C.I. acid black: 1, 2, 7, 24, 26, 94

C.I. food yellow: 3, 4

C.I. food red: 7, 9, 14

C.I. food black: 2

C.I. direct yellow: 1, 12, 24, 26, 33, 44, 50, 142, 144, 865

C.I. direct red: 1, 4, 9, 13, 17, 20, 28, 31, 39, 80, 83, 89, 225, 227

C.I. direct orange: 26, 29, 62, 102

C.I. direct blue: 1, 2, 6, 15, 22, 25, 71, 76, 79, 86, 87, 90, 98, 163, 165, 202

C.I. direct black: 19, 22, 32, 38, 51, 56, 71, 74, 75, 77, 154, 168

C.I. basic yellow: 1, 2, 11, 14, 15, 19, 21, 23, 24, 25, 28, 29, 32, 36, 40, 41, 45, 49, 51, 53, 63, 65, 67, 70, 73, 77, 87, 91

C.I. basic red: 2, 12, 13, 14, 15, 18, 22, 23, 24, 27, 29, 35, 36, 39, 46, 51, 52, 54, 59, 68, 69, 70, 73, 78, 82, 102, 104, 109, 112

C.I. basic blue: 1, 3, 5, 7, 9, 21, 22, 26, 35, 41, 45, 47, 54, 62, 65, 66, 67, 69, 75, 77, 78, 89, 92, 93, 105, 117, 120, 122, 124, 129, 137, 141, 147, 155

C.I. basic black: 2, 8

The pigment can be organic pigment such as azo pigment, phtalocyanine pigment, anthraquinone pigment, quinacridon pigment, diexazine pigment, indigo pigment, dioindigo pigment, perynone pigment, perylene pigment, iso-indolenone pigment, aniline black, azomethine azo pigment, carbon block and others. The inorganic pigment can be iron oxide, titanium oxide, calcium carbonate, baruim sulfate, ammonium hydroxide, barium yellow, prussian blue, cadmium red, chrome yellow and metal powder.

The dispersed pigment compounds can be polyacrylamide, polyacryrate and other alkali metallic salt, soluble styrene arcylic resin and their acryl family resin, soluble vinyl napthalene acid resin, polyvinyl pyrrolidone, polyvinyl alcohol, and its alkali salt, macromolecule compound which includes salt with cation functional group such as ammonium and amino group etc., polyethylene oxide, gelatine, casein and other proteins, arabia rubber, traganth rubber and other natural rubber, saponin and other qlucoxyde, carboxy-methyl cellulose, hydroxyethyl cellulose, methyl cellulose and other cellulose inductors, lignin sulfonic acid and its salt, ceramics and other natural macromolecule compounds, and the like.

The oil-based type of recording agents can be those in which lipophilic pigment is dissolved in an organic compound, those in which pigment is dispersed in an organic compound, those in which pigment or colorant is emulsified in an oil base, and the like.

Representative examples of the oil-based type pigments are indicated as follows:

C.I. solvent yellow: 1, 2, 3, 4, 5, 6, 7, 8, 9, 10, 11, 12, 14, 16, 17, 26, 27, 29, 30, 39, 40, 46, 49, 50, 51, 56, 61, 80, 86, 87, 89, 96

C.I. solvent orange: 12, 23, 31, 43, 51, 61

C.I. solvent red: 1, 2, 3, 16, 17, 18, 19, 20, 22, 24, 25, 26, 40, 52, 59, 60, 63, 67, 68, 121

C.I. solvent violet: 7, 16, 17,

C.I. solvent blue: 2, 6, 11, 15, 20, 30, 31, 32, 36, 55, 58, 71, 72

C.I. solvent brown: 2, 10, 15, 21, 22

C.I. solvent black: 3, 10, 11, 12, 13

In addition, oil bases in which pigment is dissolved or in which pigment is dispersed include n-octane, n-decan, Milanese spirit, ligroin, naptha, benzene, toluene, xylene and other hydrocarbons; dibytyl ether, dihexyl ether, anisole, phenetole, dibenzyl ether and other ethers; and methanol ethanol, isopropyl alcohol, benzyl alcohol, ethylene glycol, diethylene glycol, glycericne and other alcohols.

It is also possible to use the above described pigments for the oil-based inks as well. Examples of the oil-based pigment dispersal agents include polymethacrylic acid ester, polyacrylic acid ester, methacrylic acid ester-acrylic acid ester copolymer, polyacetic acid vinyl, vynil chloride-vinyl acetate copolymer, polyvinyl pyrrolidone, polyvinyl butyral and other vinyl copolymers, ester cellulose, methyl cellulose and other cellulose resins, polyester, polyamidem phenol resin and other polypmet resins, rosin, ceramics, relative, casein and other natural resins and the like.

In the recording process described above, the liquid adhesive areas to which the liquid such as ink can strongly adhere are formed on the surface of the recording medium so that the latent image is formed thereon. A tacking force with respect to the ink (recording agent) at the liquid adhesive areas is greater than that at other areas on the surface of the recording medium. The visible image is formed by use of a difference between the tacking forces with respect to the ink at the adhesive areas and other areas. In this recording process, the ink does not always adhere to each entire adhesive area, and thus an area to which the ink actually adheres is slightly smaller than each corresponding adhesive area. In addition, a position of the area which the ink actually adheres to slightly differs from a position of each corresponding liquid adhesive area.

Figure 15A:
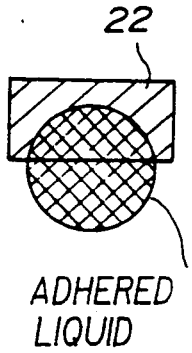
FIGS. 15A, B, C show liquid adhesive areas and areas on which the liquid actually adheres.
Figure 15B:
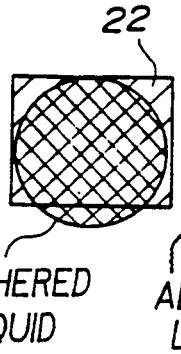
Figure 15C:
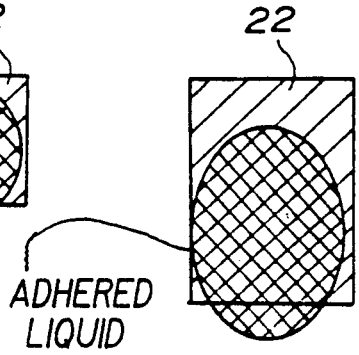

FIGS. 15A, B, C show a state where the ink adheres to the surface of the recording medium. In FIGS. 15A, B, C areas indicated by oblique lines are the liquid adhesive areas, and areas indicated by many cross oblique lines are the areas to which the ink actually adheres. That is, as shown in FIGS. 15A, B, C, each area which the ink actually adheres to does not conform with a corresponding one of the liquid adhesive areas 22.

Then, the inventors of the present invention examined various states of the adhesion of the ink to various sized liquid adhesive areas. From the results of this examination, the inventors recognized that the size of each area to which the ink actually adheres changes in accordance with the size of each corresponding liquid adhesive area. That is, the size of each area which the ink actually adheres to can be controlled by changing the size of each corresponding liquid adhesive area. In the recording process described above, when the size of an area which is heated is controlled, the size of the liquid adhesive area is controlled.

In the recording process of the invention, the surface of the recording medium (A) is partially heated in a condition in which the liquid is in contact with the surface of the recording medium, and thus a heated area on the surface of the recording medium (A) changes to the liquid adhesive area. In various areas which are heated on the surface of the recording medium (A), the temperature of each heated area does not always exactly correspond to the amount of a liquid (including a recording agent) adhering thereto.

Figure 16:
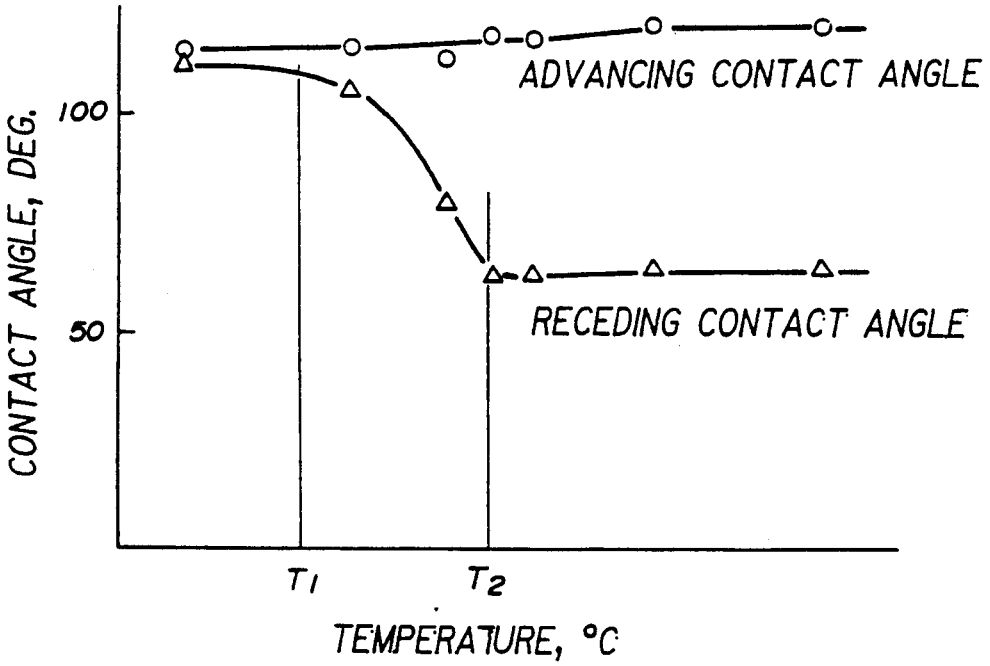
FIG. 16 is a graph illustrating a relationship between the contact angles and the temperature.

The inventors of the present invention also examined the relationship between the temperature of the area on the surface of the recording medium and the amount of liquid adhering to the area. From the results of this examination, the inventors recognized that an adhesive force which makes the liquid adhere to the liquid adhesive area on the surface of the recording medium (A) could be controlled by controlling the temperature of the liquid adhesive area. FIG. 16 shows a typical example of the contact angle (including the advancing contact angle and the receding contact angle) of the surface of the recording medium (A) with respect to pure water in various cases where the liquid adhesive area has any temperature value. In FIG. 16, the receding contact angle decreases in accordance with the increasing of the temperature of the adhesive area, between the temperatures $T_1$ and $T_2$. That is, between the temperatures $T_1$ and $T_2$, the adhesive force on the liquid adhesive area can be controlled by the temperature of the adhesive area. In the recording process described above, when the temperature of the liquid adhesive area is controlled, the amount of the liquid actually adhering to the adhesive area is controlled. That is, the size of an area which the liquid actually adheres to can be controlled.

Figure 17B:
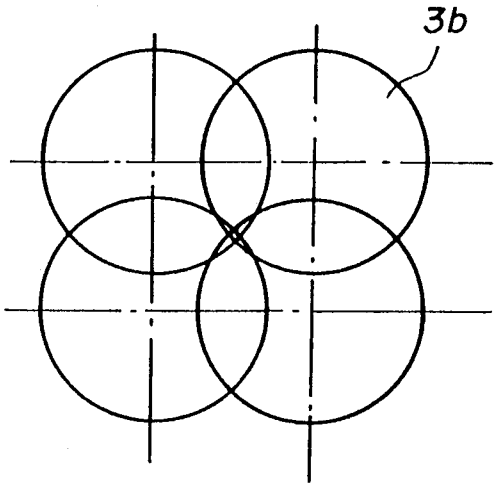
FIGS. 17A, B and 18A, B are views indicating a relationship between the size of the liquid adhesive areas and the dot size corresponding to each liquid adhesive area.
Figure 17A:
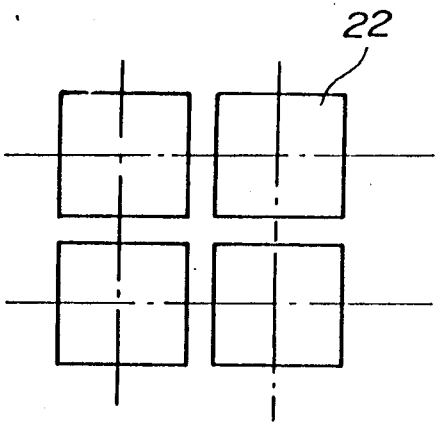

To obtain the gradational image, for example, one pixel in the image is expressed by a dot matrix in which a plurality of dots are arranged in a matrix. In a case where one pixel is expressed by a $2\times2$ dot matrix, as shown in FIG. 17A, $2\times2$ liquid adhesive areas 22 corresponding to one pixel are formed on the surface of the recording medium (A). Then, when the ink adheres to the liquid adhesive areas 22 and is transferred to the recording sheet, a dot image including $2\times2$ ink dots 3*b* for one pixel is formed on the recording sheet, as shown in FIG. 17B.

Figure 18B:
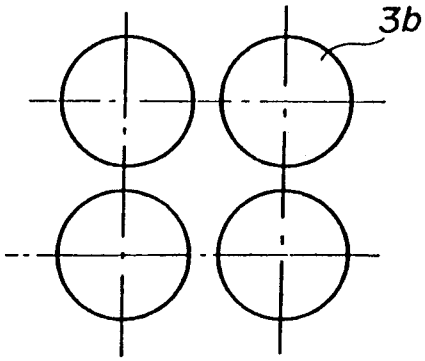
Figure 18A:
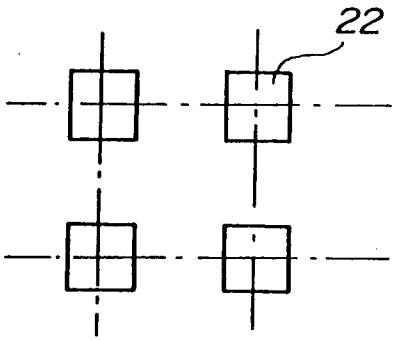

Then, when a heated area corresponding to each dot is made small, the size of each corresponding liquid adhesive area 22 formed on the surface of the recording medium (A) becomes small, as shown in FIG. 18A. In this case, the amount of the ink adhering to each adhesive area 22 in the developing process decreases, so that the size of each of the dots for one pixel formed on the recording sheet in the transferring process decreases, as shown in FIG. 18B. As a result, an optical density for one pixel shown in FIG. 18B becomes lower than that shown in FIG. 17B. That is, an optical density for one pixel can be controlled by controlling the size of each liquid adhesive area corresponding to one pixel, and thus the gradational image can be obtained.

Figure 19B:
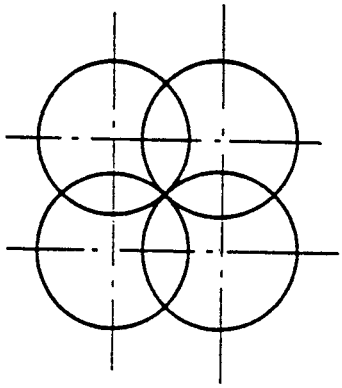
FIGS. 19A, B and 20A, B are views indicating a state where the dot size changes when the temperature of the liquid adhesive area changes.
Figure 20B:
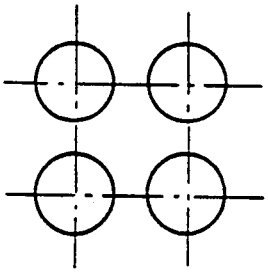
Figure 19A:
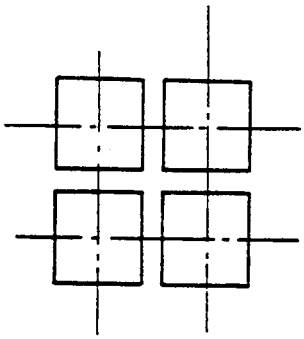
Figure 20A:
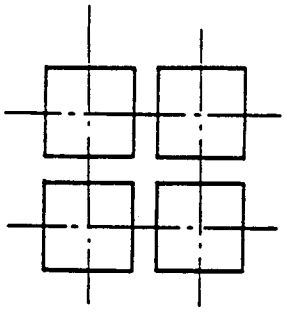

On the other hand, when the temperature of a heated area corresponding to each dot is decreased, the amount of the ink adhering to each corresponding liquid adhesive area 22 decreases even if the size of each corresponding liquid adhesive area 22 does not change, as shown in FIG. 19A and FIG. 20A. In this case, the size of each dot for one pixel formed on the recording sheet in the transferring process decreases, as shown in FIG. 19B. As a result, the optical density for one pixel shown in FIG. 20B becomes smaller than that for the pixel shown in FIG. 19B. That is, the optical density for one pixel can be controlled by controlling the temperature of each liquid adhesive area corresponding to one pixel, and then the gradational image can be obtained.

As has been described above, according to the present invention, the size of an area which the liquid actually adheres to on the surface of the recording medium (A) is controlled in accordance with the size and/or the temperature of the liquid adhesive area which is formed on the surface of the recording medium. That is, the size of each dot which the ink adheres to is controlled so that a gradational image is obtained.

When the variation of the size or the temperature of each liquid adhesive area is 16 steps and one pixel is expressed by a 2×2 dot matrix, the gradational image of 3876 steps can be obtained. On the surface of the recording medium (A) described above, it is easy to successively control the size or the temperature of each liquid adhesive area (for example, in 16 steps). Therefore, the gradational image is easily obtained. In addition, when both the size and the temperature of each adhesive area are controlled, it is possible to obtain a superior gradational image.

EXAMPLES

A description will now be given of specific examples of the present invention.

Figure 21:
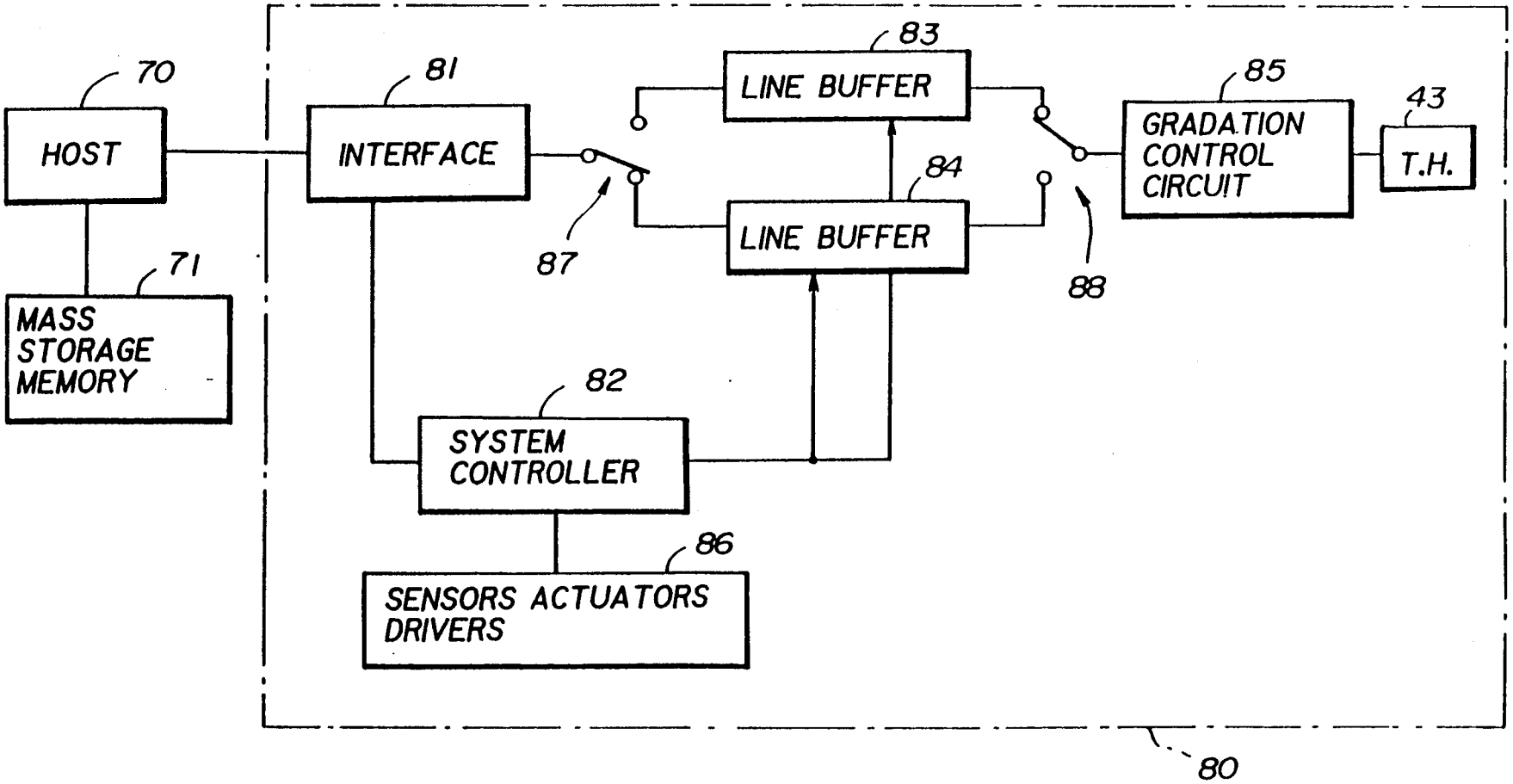
FIG. 21 is a block diagram illustrating a system for printing an image.

First, a system for forming the gradational image is, for example, structured as shown in FIG. 21.

Referring to FIG. 21, a host 70 and a mass storage memory 71 are connected to each other. A printer 80 is connected to the host 70 and commands, status information, image data and the like are supplied from the host 70 to the printer 80. The printer 80 has an interface 81, a system controller 82, line buffers 83 and 84, a gradation control circuit 85 and the thermal head unit 43. The thermal head unit 43 has a thermal head in which 3072 thermal elements are arranged in a line (for example, 10 elements/mm) and 48 driving ICs (64 bits) for driving the thermal head. The capacity of each of the line buffers 83 and 84 is 3072 bytes. A switch 87 selects one of the line buffers 83 and 84 which selected butter is connected to the interface 81. A switch 88 selects one of the line buffers 83 and 84, which selected buffer is connected to the gradation control circuit 85.

In the above system, the commands and the status information are respectively supplied from the host 70 via the interface 81 to the system controller 82 of the printer 80. The printer 80 receives image data from the host 70 by DMA (direct memory access) when the printer 80 records the image. The switches 87 and 88 switch so that one of the line buffers 83 and 84 is connected to the interface 81 and another line buffer is connected to the gradational control circuit 85. Thus, it is possible for the printer 80 to print the image while the image data is being received. The gradation control circuit outputs a driving pulse signal in which the level or the width thereof is modulated in accordance with the image data supplied from the host 70. The image data is gradational data of 64 steps. The thermal head unit 43 is driven in accordance with the driving pulse signal supplied from the gradation control circuit.

Figure 22:
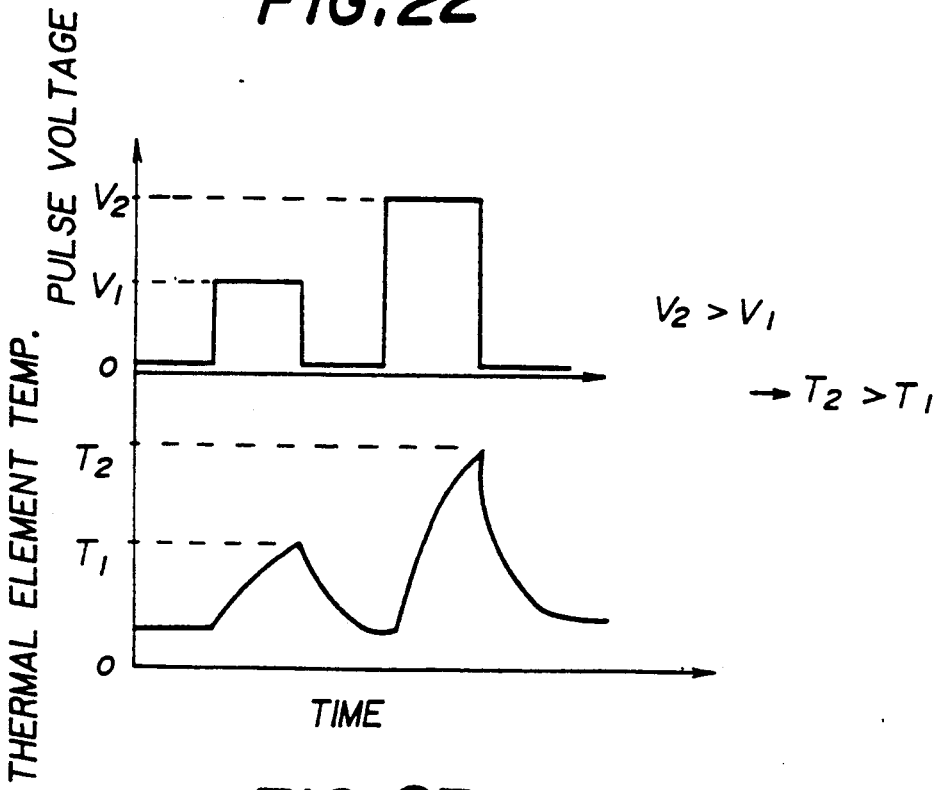
FIGS. 22 and 23 are timing charts illustrating a driving pulse signal and the temperature of a thermal element.
Figure 23:
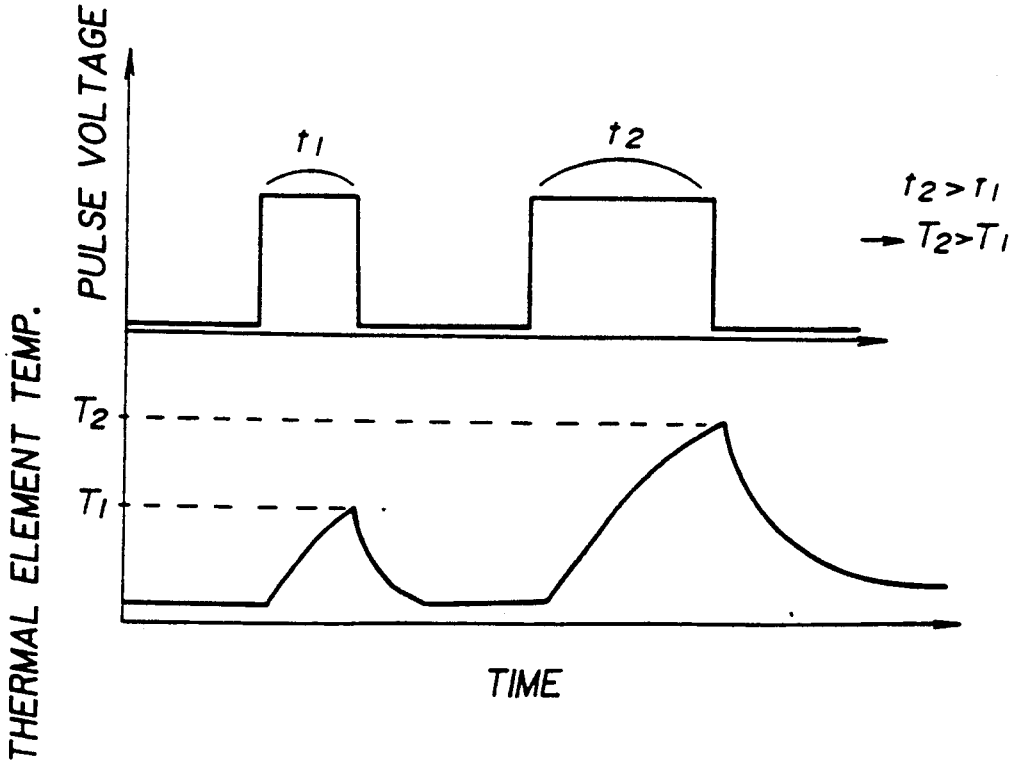

In a case where the level of the driving pulse is modulated in accordance with the image data, the first temperature T1 of each thermal element (thermal resistance) of the thermal head which the driving pulse having a first level V1 is supplied to is less than the second temperature T2 of each thermal element which the driving pulse having a second level V2 greater than the first level V1 is supplied to, as shown in FIG. 22 (V2>V1, T2>T1). In a case where the width of the driving pulse is modulated in accordance with the image data, the first temperature T1 of each thermal element of the thermal head which the driving pulse signal having a first width t1 is supplied to is less than the second temperature T2 of each thermal element which the driving pulse signal having a second width t2 greater than the first width is supplied to, as shown in FIG. 23 (t2>t1, T2>T1).

For example, if the substrate 1 of the recording medium (A) is made of a thermal anisotropy member in which a heat conductivity in directions parallel to the surface thereof is less than a heat conductivity in a direction perpendicular to the surface thereof, the temperature of the liquid adhesive area (latent image) can be controlled without changing the size of the liquid adhesive area. The thin film 2 (hereinafter referred to as a recording layer) on which the liquid adhesive areas can be formed is stacked on the surface of the thermal anisotropy so that the recording medium (A) is made. In this case, heat supplied from the heater element of the thermal head to the recording layer is mainly transmitted in a direction perpendicular to the surface of the recording layer, and it is difficult for the heat to be transmitted in directions parallel to the surface of the recording layer. Thus, the liquid adhesive area which is formed by heating the recording layer in a condition in which the liquid is in contact with the recording layer is hardly extended in the directions parallel to the surface of the recording layer even if the temperature of the thermal element of the thermal head increases. As a result, when the width of the driving pulse signal is controlled, the temperature of the adhesive area is controlled without the size thereof being changed.

Figure 24:
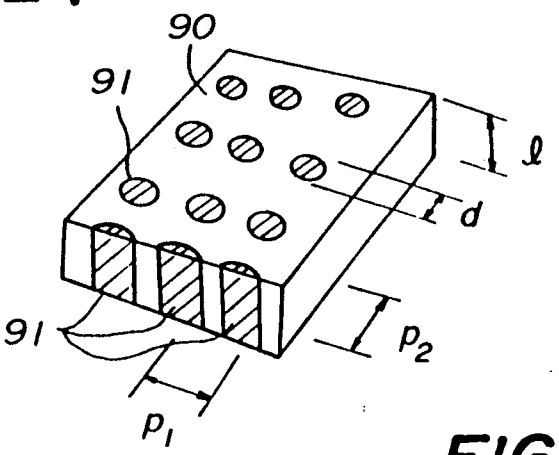
FIG. 24 is a perspective view illustrating an example of the substrate.

The thermal anisotropy member used as the substrate 1 of the recording medium (A) is made as shown in FIG. 24. That is, a plurality of good conductive members 91 each having a large heat conductivity are provided in a poor conductive member 90 having a small heat conductivity. The good conductive members 91 are extended in a direction perpendicular to the surface of the poor conductive member 90 and are parallel to each other. Furthermore, the good conductive members 91 are arranged in a matrix in the poor conductive member 90. Each good conductive member 91 can be formed of metal filler or conductive rubber including carbon and the like. The poor conductive member 90 can be formed of resin or rubber. The good conductive members 91 and the poor conductive member 90 are integrated with each other by means of pressing so that the thermal anisotropy is formed.

It is preferable that a first pitch $p_1$ between each pair of adjacent good conductive members in a first direction and a second pitch $p_2$ between each pair of adjacent good conductive members in a second direction perpendicular to the first direction be equal to or less than a pitch between each pair of adjacent liquid adhesive areas (adjacent dots in the latent image) which should be formed on the surface of the recording layer. In addition, it is preferable that the size d of a section of each good conductive member be equal to or less than the size of the liquid adhesive area (dot). Furthermore, the thickness of the recording layer can preferably be in a range of from a few 100 Å to a few microns, and the thickness 1 of the substrate 1 formed of the thermal anisotropy can preferably be equal to or greater than 0.1 mm. The heat conductivity of the good heat conductive member 91 is preferably equal to or greater than 0.01 cal/cm sec.°c.

EXAMPLE 1

The recording layer was made of polymer which is obtained by solution polymerization of acrylate monomer including fluorine. Each good heat conductive member 91 was formed of the conductive rubber, and the poor heat conductive member 90 was formed of rubber. The substrate 1 (thermal anisotropy) was formed as shown in FIG. 24. In the substrate 1 shown in FIG. 24, $t_1=t_2=125$ μm, d=80 μm and l=1 mm. The recording layer was coated on the substrate 1 so that the recording medium (A) was formed.

The water-soluble ink was used as the contact material (B). The thermal head in which the thermal elements were arranged at a rate of 8 dots/mm was used for printing. In a first case, the thermal head was driven in accordance with the driving pulse in which the width thereof was 1 msec. and the level thereof was 10 v. In a second case, the thermal head was driven in accordance with the driving pulse in which the width thereof was 0.5 msec. and the level thereof was 10 v.

The optical density of a dot obtained in the above first case differed from that of a dot obtained in the above second case. That is, due to controlling the width of the driving pulse, the density of the dot can be controlled.

Figure 25B:
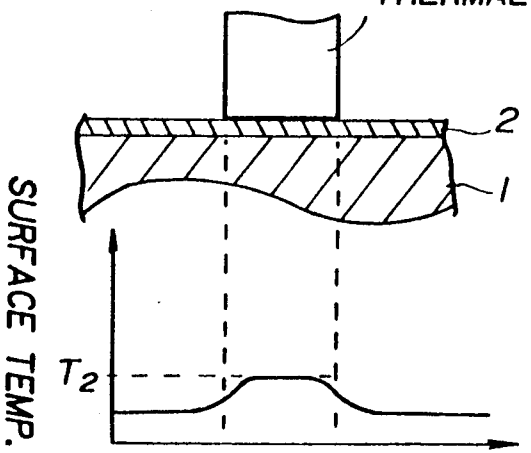
FIGS. 25A, 25B, 26A, 26B and 27 show examples of temperature of heated area on the recording medium.
Figure 25A:
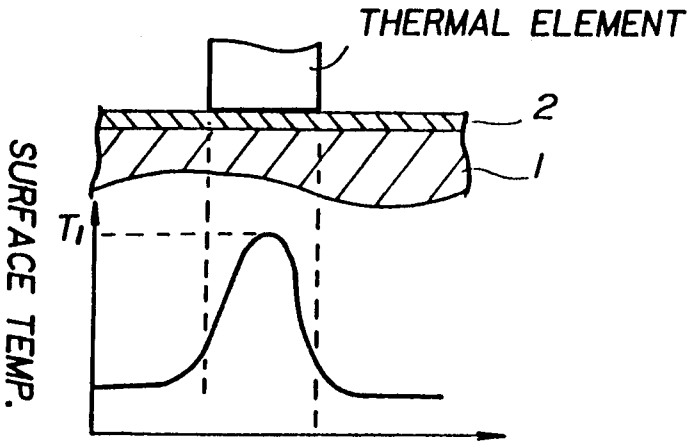

In a case where the substrate 1 of the recording medium (A) is formed of only a good conductive member, the heat supplied from the thermal element of the thermal head rapidly disperses in the substrate 1, so that it is difficult for the temperature of the substrate 1 to increase. In this case, the temperature distribution in an area heated by the heater element is more uniform than that in the case where the substrate 1 is formed of the poor heat conductive member, as shown in FIGS. 25A and 25B.

The substrate 1 can be made of metal, ceramic, conductive rubber or conductive resin, which materials have good conductivity. The thickness of the recording layer formed on the substrate is preferably in a range of from a few 100 Å to a few microns.

EXAMPLE 2

The substrate 1 was a cylinder made of aluminum. The recording layer coated on the substrate 1 was made of methacylate including fluorine. Oil-based ink was used as the recording agent.

In a first case, the thermal head was driven in accordance with the driving pulse signal in which the width thereof was 1 msec. and the level thereof was 10 v. In a second case, the thermal head was driven in accordance with the driving pulse signal in which the width thereof was 1 msec. and the level thereof was 12 v. In a third case, the thermal head was driven in accordance with the driving pulse signal in which the width thereof was 0.5 msec. and the level thereof was 10 v.

When a dot image was formed in the above conditions, the results shown in Table-1 were obtained.

TABLE 1

| CASE No. | D. PULSE WIDTH | D. PULSE LEVEL | OPTICAL DENSITY |
|---|---|---|---|
| 1 | 1 msec. | 10 v | 1.0 |
| 2 | 1 msec. | 12 v | 1.3 |
| 3 | 0.5 msec. | 10 v | 0.7 |

In Table-1, the optical density of each case is expressed as a relative value based on the value of the first case.

That is, it is possible to control the optical density of the dot image by controlling the width or the level of the driving pulse signal supplied to the thermal head.

Figure 26B:
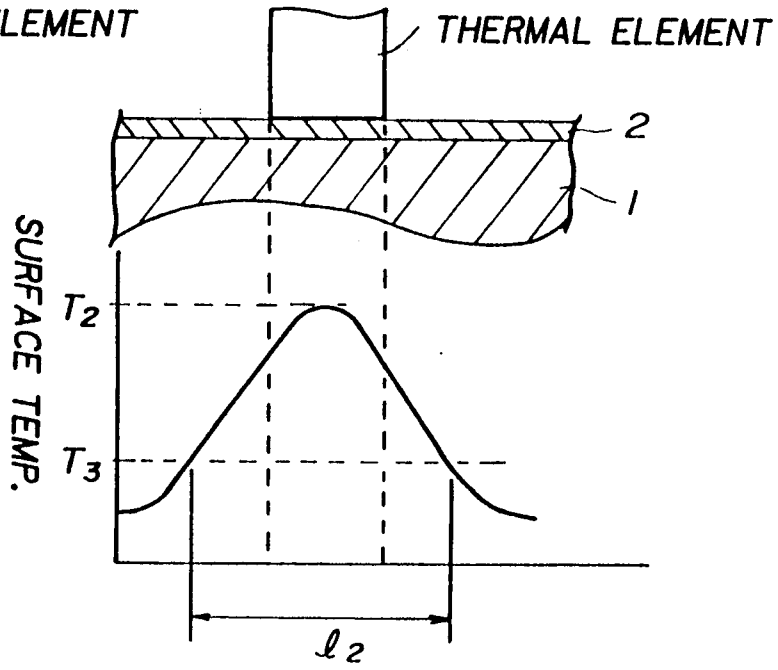
Figure 26A:
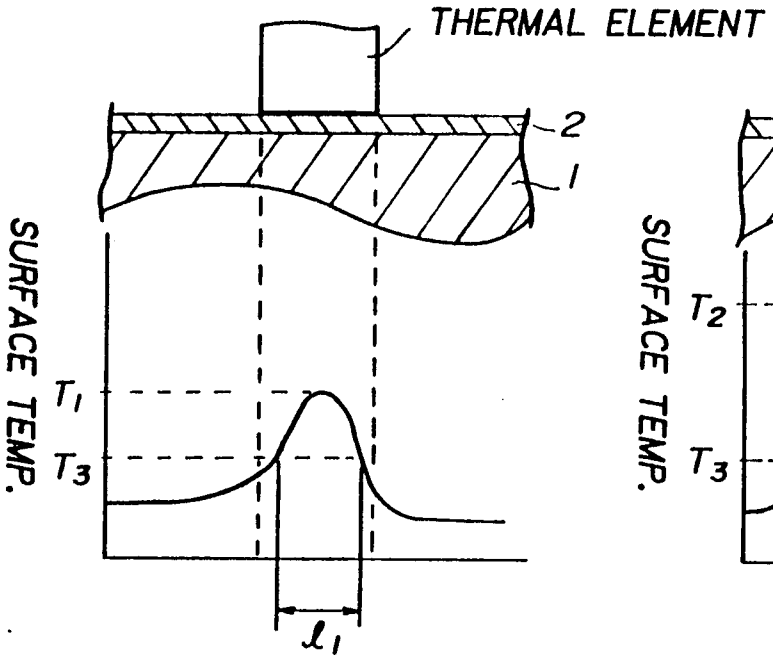

In a case where the substrate 1 is made of the poor heat conductive member having a low heat conductivity, as it is difficult for the heat supplied to the substrate 1 to disperse in the substrate 1, the temperature of the recording layer formed on the substrate 1 can easily increase. But, a heat distribution on the heated area of the recording layer easily becomes ununiform. Thus, both the size and the temperature of the liquid adhesive area (heated area) formed on the recording layer can be changed by changing the shape of the driving pulse signal supplied to the thermal element. That is, when the amount of energy supplied to the thermal element is large, the size of the area heated by the thermal element are is large and the temperature thereof is high. When a first energy $p_1$ supplied to the thermal element (in a case shown in FIG. 26A) is less than a second energy $p_2$ supplied thereto (in a case shown in FIG. 26B), the size $l_1$ of the area heated by the thermal element which the first energy $p_1$ is supplied to is smaller than the size $l_2$ of the area heated by the thermal element which the second energy $p_2$ is supplied to. The above also applied to the temperature $T_1$ which is lower than the temperature $T_2$.

EXAMPLE 3

Polyimide resin was coated on a cylinder (ϕ 100 mm) so that the substrate 1 was made. The recording layer was made of methacylate including fluorine ("TEXGARD TG-702" manufactured by DAIKIN MANUFACTURING CO., LTD.). Then the recording layer was coated on the polyimide resin layer of the substrate 1, and a stacked structure consisting of the substrate 1 and the recording layer was dried at 90° for 30 min., so that the recording medium was made. The recording medium was heated via the water-soluble ink by the thermal head (8 dots/mm), as shown in FIG. 13. In a first case, the width of the driving pulse signal was 1 msec. and the level (voltage) thereof was 12 v. In a second case, the width of the driving pulse was 1 msec. and the level thereof was 10 v.

In the above two cases, the following results were obtained.

The size of the dot formed in the first case was 1.3 times as large as the size of the dot formed in the second case. In addition, when a pixel formed of a 2×2 dot matrix was printed on the recording sheet in each of the cases, the optical density of the pixel obtained in the first case was twice as high as that of the pixel obtained in the second case.

EXAMPLE 4

The recording medium was made in the same manner as that used in Example 3. The recording medium 7 which moved at a speed of 50 mm/sec was heated via the water-soluble ink 3*a* by the thermal head (8 dots/mm), as shown in FIG. 13. In a first case, the width of the driving pulse signal was 0.5 msec. and the level (voltage) thereof was 12 v. In a second case, the width of the driving pulse signal was 1 msec. and the level thereof was 12 v.

In the above two cases, the following results were obtained. The size of the dot formed in the second case was 1.3 times as large as the size of the dot formed in the first case.

EXAMPLE 5

The recording medium was made in the same manner as that used in Example 3. The recording medium 7 was heated via the water-soluble ink by the thermal head (8 dots/mm), as shown in FIG. 13. In a first case, the width of the driving pulse signal was 0.5 msec. and the level (voltage) thereof was 5 v. In a second case, the width of the driving pulse signal was 0.7 msec. and the level thereof was 5 v.

In the above two cases, the following results were obtained. The size of the dot formed in the second case was 1.3 times as large as the size of the dot formed in the first case.

Figure 27:
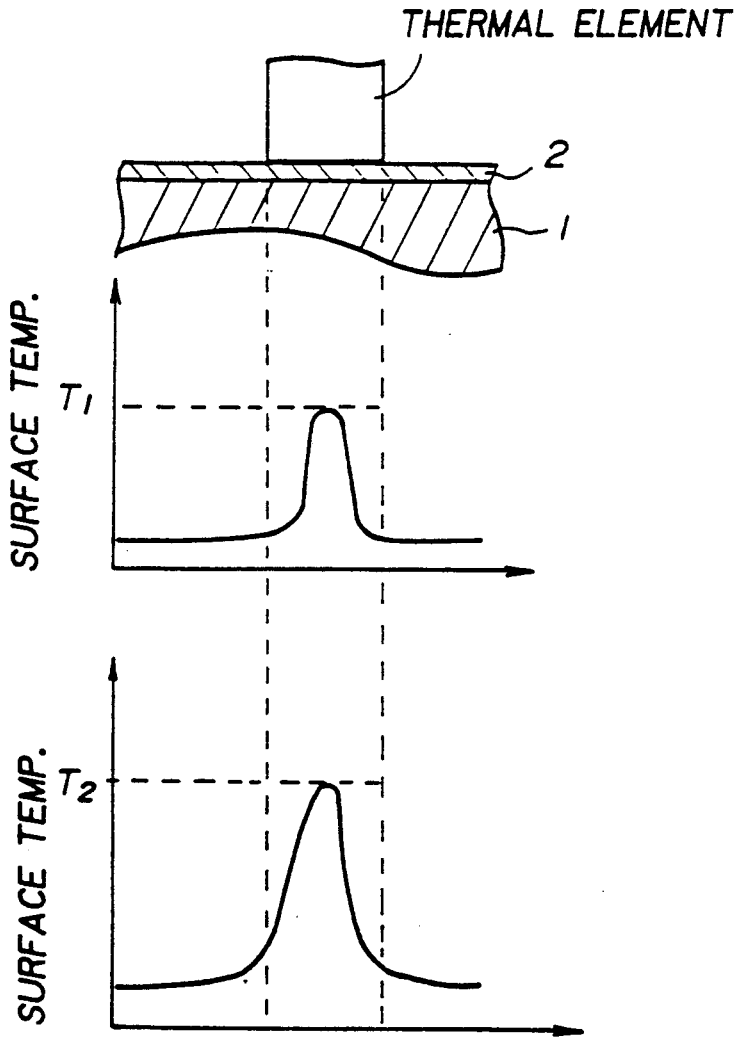

When a narrow pulse having a very small width is supplied to the thermal element of the thermal head, it is difficult for the heat supplied from the thermal element to the recording medium to disperse in the recording medium, and the temperature on the heated area can easily be controlled. That is, as shown in FIG. 27, in a case where the width of the narrow pulse is t, when the level $V_p$ of the arrow pulse changes from $V_1$ to $V_2$ ($>V_1$), the temperature of the heated area can change from $T_1$ to $T_2$ ($>T_1$) without the size of the heated area be changed.

The width of the narrow pulse can be in a range of from 0.05 msec to 0.5 msec. It is preferable that the width o the narrow pulse supplied to the thermal head be approximately 0.1 msec.

EXAMPLE 6

The recording medium was made in the same manner as that used in Example 3. The recording medium was heated via the water-soluble ink by the thermal head (8 dots/mm), as shown in FIG. 13. In a first case, the width of the narrow pulse was 0.1 msec. and the level (voltage) thereof was 22 v. In a second case, the width of the narrow pulse was 0.1 msec. and the level thereof was 15 v.

In the above two cases, the following results were obtained.

The size of the dot formed on the recording sheet in the first case was 1.3 times as large as the size of the dot formed in the second case. In addition, when a pixel formed of a 2×2 dot matrix was printed on the recording sheet in each of the cases, the optical density of the pixel obtained in the first case was twice as high as that of the pixel obtained in the second case.

Figure 28:
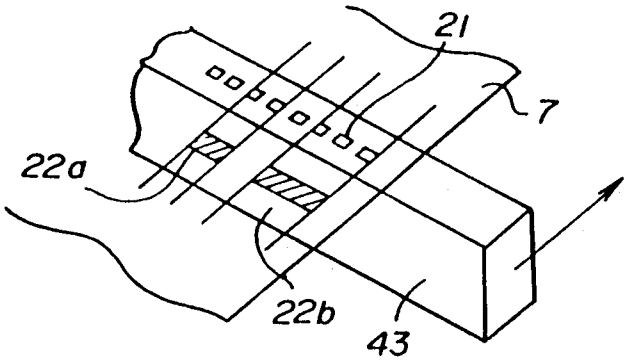

The size of the dot can be controlled by controlling the number of thermal elements of the thermal head which are driven. That is, as shown in FIG. 28, a liquid adhesive area 22*a* which is formed on the recording medium 7 by driving two thermal elements 21 of the thermal head 43 is smaller than a liquid adhesive area 22*b* which is obtained by driving three thermal elements 21.

EXAMPLE 7

Figure 29A:
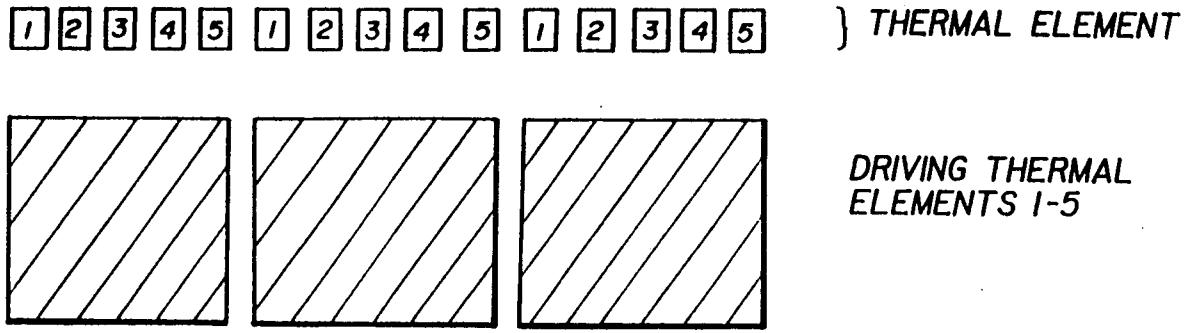
FIGS. 29A, B and 30 are views showing relationships between the number of driven thermal elements and the size of one pixel.
Figure 29B:
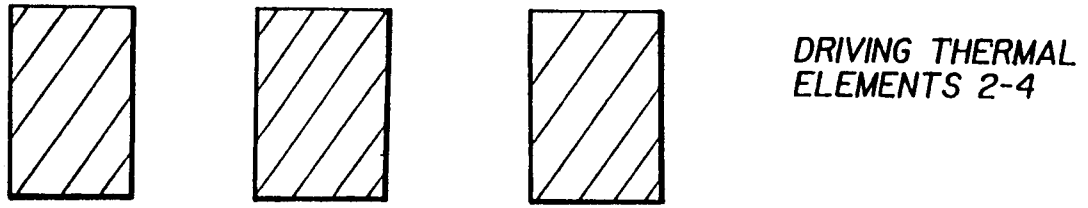

The thermal head had thermal elements which were arranged in a line at a rate of 40 dots per millimeter (40 dots/mm). Each thermal element had an area of 20 μm×20 μm. One pixel corresponded to five thermal elements so that a dot image of 200 DPI (8 dots/mm) was formed on the recording sheet. That is, when the five thermal elements were driven so that one pixel was formed, liquid adhesive areas as shown in FIG. 29(*a*) were obtained, and when the three thermal elements were driven so that one pixel was formed, the liquid adhesive areas as shown in FIG. 29(*b*) were obtained. When the number of the driven thermal elements (No. 1 to No. 5) corresponding to one pixel changed, the size of the liquid adhesive area and the optical density changed as indicated in Table-2.

TABLE 2

| DRIVEN ELEMENTS | SIZE OF AREA | OPTICAL DENSITY |
|---|---|---|
| 1, 2, 3, 4, 5 | L 100 μm × W 100 μm | 1.0 |
| 1, 2, 3, 4 | L 100 μm × W 80 μm | 0.7 |
| 2, 3, 4 | L 100 μm × W 60 μm | 0.5 |
| 3, 4 | L 100 μm × W 40 μm | 0.3 |
| 3 | L 100 μm × W 20 μm | 0.2 |

Figure 30:
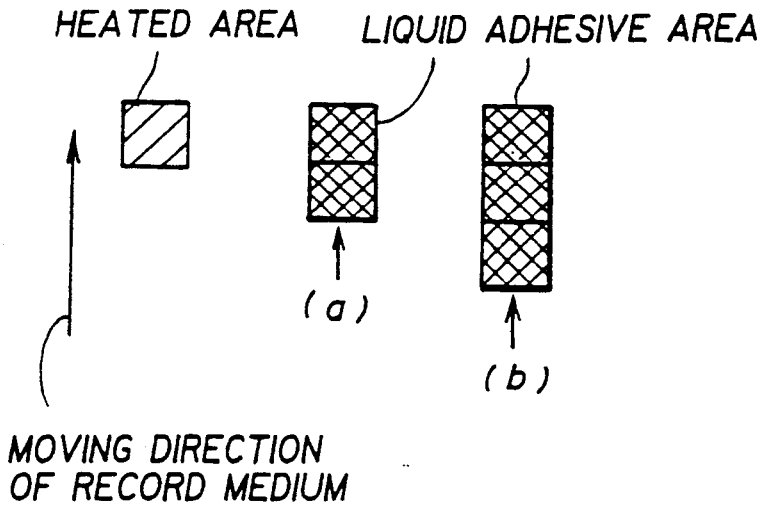

When the recording medium moves at a constant speed, the size of the liquid adhesive area can also be controlled by controlling a time for supplying the power to each corresponding thermal element. That is, when the time for driving each corresponding thermal element increases, the size of the liquid adhesive area increases, as shown in FIG. 30.

Figure 31:
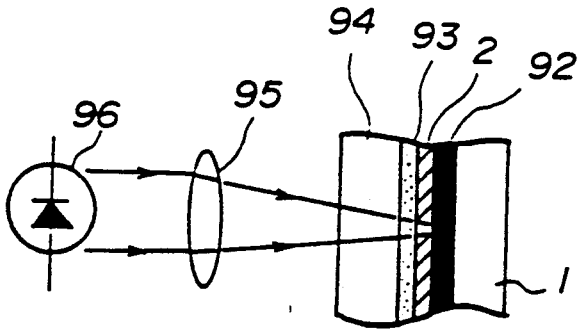
FIG. 31 is a view showing mechanism in which a laser beam heats the surface of the recording medium.

A light source can be used as the heat source for heating the recording layer of the recording medium. The principle in which a laser beam heats the recording layer is, for example, shown in FIG. 31. Referring to FIG. 31, a light absorption layer 92 which absorbs a light is formed on the substrate 1. The recording layer 2, a water layer 93 and a transparent glass 94 are stacked on the light absorption layer 92 in this order. A laser beam emitted from a laser diode 96 is focused on the surface of the recording layer 2 by a lens 95.

EXAMPLE 8

The substrate 1 was made of a polyimide film (CAPTON manufactured by TORAY-DUPONT CO., LTD.) and had a thickness of 75 μm. Epoxy resin in which carbon black is mixed was coated on the substrate 1 and cured so that the light absorption layer 92 was formed on the substrate 1. The recording layer 2 was formed of polymer of "Viscoat 17F" manufactured by OSAKA ORGANIC CHEMICAL CO., LTD. and had a thickness of 1000 Å. The water layer was formed a pure water and had a thickness of 1 μm. The transparent glass was a plate glass and had a thickness of 1.8 mm. The laser diode was a LN 9850 manufactured by PANASONIC.

In a first case, the spot size of the laser beam formed on the surface of the recording layer 2 was 40 um, an operation current of the laser diode 96 was 70 mA and the width of the driving pulse was 10 msec. In a second case, the spot size of the laser beam formed on the surface of the recording layer 2 was 100 um, the operation current of the laser diode 96 was 150 mA and the width of the driving pulse was 10 msec.

After the latent image was formed on the recording layer under the conditions of the above two cases, the latent image was developed by the water-soluble ink (at 20° C., the coefficient of viscosity was 50 cp and the surface tension was 48 dyn/cm). Then the developed image was transferred to the recording sheet (TYPE 6200 paper manufactured by RICOH CO., LTD). As a result, the size of the dot formed on the recording sheet in the second case was twice as large as the size of the dot formed in the second case.

What is claimed is:

1. A process for forming a dot image on a recording medium which has a surface having a characteristic in which a receding contact angle decreases when said recording medium is heated in a condition where said recording medium is in contact with a liquid, a vapor or a solid which generates or changes to either a vapor or a liquid at a temperature lower than a temperature at which the receding contact angle on said recording medium starts to decrease, said process comprising in any order the following steps (a) and (b) of:

(a) selectively heating the surface of said recording medium so that one or a plurality of heated areas are formed on the surface of said recording medium in accordance with image information, the size of each heated area being controlled in accordance with the image information; and (b) bringing a contact material into contact with the surface of said recording medium, said contact material being either a liquid, a vapor or a solid which generates or changes to either a vapor or a liquid at a temperature lower than a temperature at which the receding contact angle on said recording medium starts to decrease, wherein the receding contact angle of each heated area decreases so that a latent image corresponding to one or the plurality of the heated areas is formed on the surface of said recording medium.

2. A process as claimed in claim 1, wherein said step (a) precedes said step (b).

3. A process as claimed in claim 1, wherein said step (b) precedes said step (a).

4. A process as claimed in claim 1 further comprising steps of removing said contact material from said surface of said recording medium and heating said surface of said recording medium, so that said latent image is erased from the surface of said recording medium.

5. A process as claimed in claim 1 further comprising a step of supplying a recording agent which includes a colorant to the surface of said recording medium on which said latent image has been formed so that the recording agent adheres to one or the plurality of the heated areas, the amount of recording agent adhering to each heated area corresponding to the size of each corresponding heated area, whereby a gradational visible image is formed on the surface of said recording medium.

6. A process as claimed in claim 5 further comprising a step of transferring the gradational visible image formed on the surface of said recording medium to another medium.

7. A process for forming a dot image on a recording medium which has a surface having a characteristic in which a receding contact angle decreases when said recording medium is heated in a condition where said recording medium is in contact with a liquid, a vapor or a solid which generates or changes to either a vapor or a liquid at a temperature lower than a temperature at which the receding contact angle on said recording medium starts to decrease, said process comprising in any order the following steps (a) and (b) of:

(a) selectively heating the surface of said recording medium so that one or a plurality of heated areas are formed on the surface of said recording medium in accordance with image information, the size of each heated area being controlled in accordance with the image information; and (b) bringing a recording agent which includes a colorant into contact with the surface of said recording medium, wherein the receding contact angle of each heated area decreases and the recording agent adheres to the heated areas, the amount of the recording agent adhering to each heated area corresponding to the size of each corresponding heated area, so that a gradational visible image is formed on the surface of said recording medium.

8. A process as claimed in claim 7, wherein said step (a) precedes said step (b).

9. A process as claimed in claim 7, wherein said step (b) precedes said step (a).

10. A process as claimed in claim 7 further comprising a step of transferring the gradational visible image formed on the surface of said recording medium to another medium, whereby the gradational visible image is formed on said another medium and a latent image corresponding to the gradational visible image is maintained on the surface of said recording medium.

11. A process as claimed in claim 10 further comprising steps of removing the recording agent from the surface of said recording medium, and heating the surface of said recording medium, so that the latent image is erased from the surface of said recording medium.

12. A process for forming a dot image on a recording medium which has a surface having a characteristic in which a receding contact angle decreases when said recording medium is heated in a condition where said recording medium is in contact with a liquid, a vapor or a solid which generates or changes to either a vapor or a liquid at a temperature lower than a temperature at which the receding contact angle on said recording medium starts to decrease, said process comprising in any order the following steps (a) and (b) of:

(a) selectively heating the surface of said recording medium so that one or a plurality of heated areas are formed on the surface of said recording medium in accordance with image information, the temperature of each heated area being controlled in accordance with the image information; and (b) bringing a contact material into contact with the surface of said recording medium, said contact material being either a liquid, a vapor or a solid which generates or changes to either a vapor or a liquid at a temperature lower than a temperature at which the receding contact angle on said recording medium starts to decrease, wherein the receding contact angle of each heated area decreases and corresponds to the temperature thereof so that a latent image corresponding to one or the plurality of the heated areas is formed on the surface of said recording medium.

13. A process as claimed in claim 12, wherein said step (a) precedes said step (b).

14. A process as claimed in claim 12, wherein said step (b) precedes said step (a).

15. A process as claimed in claim 12 further comprising steps of removing said contact material from said surface of said recording medium and heating said surface of said recording medium, so that said latent image is erased from the surface of said recording medium.

16. A process as claimed in claim 12 further comprising a step of supplying a recording agent which includes a colorant to the surface of said recording medium on which said latent image has been formed so that the recording agent adheres to one or the plurality of the heated areas, the amount of recording agent adhering to each heated area corresponding to the temperature of each corresponding heated area, whereby a gradational visible image is formed on the surface of said recording medium.

17. A process as claimed in claim 16 further comprising a step of transferring the gradational visible image formed on the surface of said recording medium to another medium.

18. A process for forming a dot image on a recording medium which has a surface having a characteristic in which a receding contact angle decreases when said recording medium is heated in a condition where said recording medium is in contact with a liquid, a vapor or a solid which generates or changes to either a vapor or a liquid at a temperature lower than a temperature at which the receding contact angle on said recording medium starts to decrease, said process comprising in any order the following steps (a) and (b) of:

(a) selectively heating the surface of said recording medium so that one or a plurality of heated areas are formed on the surface of said recording medium in accordance with image information, the temperature of each heated area being controlled in accordance with the image information; and (b) bringing a recording agent which includes a colorant into contact with the surface of said recording medium, wherein the receding contact angle of each heated area decreases and corresponds to the temperature thereof and the recording agent adheres to the heated areas, the amount of the recording agent adhering to each heated area corresponding to the temperature of each corresponding heated area, so that a gradational visible image is formed on the surface of said recording medium.

19. A process as claimed in claim 18, wherein said step (a) precedes said step (b).

20. A process as claimed in claim 18, wherein said step (b) precedes said step (a).

21. A process as claimed in claim 18 further comprising a step of transferring the gradational visible image formed on the surface of said recording medium to another medium, whereby the gradational visible image is formed on said another medium and a latent image corresponding to the gradational visible image is maintained on the surface of the recording medium.

22. A process as claimed in claim 21 further comprising steps of removing the recording agent from the surface of said recording medium, and heating the surface of said recording medium, so that the latent image is erased from the surface of said recording medium.

23. A process for forming a dot image on a recording medium which has a surface having a characteristic in which a receding contact angle decreases when said recording medium is heated in a condition where said recording medium is in contact with a liquid, a vapor or a solid which generates or changes to either a vapor or a liquid at a temperature lower than a temperature at which the receding contact angle on said recording medium starts to decrease, said process comprising in any order the following steps (a) and (b) of:

(a) selectively heating the surface of said recording medium so that one or a plurality of heated areas are formed on the surface of said recording medium in accordance with image information, the size of each heated area and the temperature thereof being controlled in accordance with the image information; and (b) bringing a contact material into contact with the surface of said recording medium, said contact material being either a liquid, a vapor or a solid which generates or changes to either a vapor or a liquid at a temperature lower than a temperature at which the receding contact angle on said recording medium starts to decrease, wherein the receding contact angle of each heated area decreases so that a latent image corresponding to one or the plurality of the heated areas is formed on the surface of said recording medium.

24. A process for controlling the size of each dot in a dot image formed on a recording medium which has a surface having a characteristic in which a receding contact angle decreases when said recording medium is heated in a condition where said recording medium is in contact with a liquid, a vapor or a solid which generates or changes to either a vapor or a liquid at a temperature lower than a temperature at which the receding contact angle on said recording medium starts to decrease, said process comprising in order the following steps (a) and (b) of:

(a) selectively heating the surface of said recording medium so that one or a plurality of heated areas are formed on the surface of said recording medium in accordance with image information, the size and temperature of each heated area being controlled in accordance with the image information; and (b) bringing a recording agent which includes a colorant into contact with the surface of said recording medium, wherein the receding contact angle of each heated area decreases and corresponds to the temperature thereof and the recording agent adheres to the heated areas, the amount of the recording agent adhering to each heated area corresponding to the size and the temperature of each corresponding heated area, so that a gradational visible image is formed on the surface of said recording medium.

25. An apparatus for recording an image comprising:

a recording medium which has a surface having a characteristic in which a receding contact angle decreases when said recording medium is heated in a condition where said recording medium is in contact with a liquid, a vapor or a solid which generates or changes to either a vapor or a liquid at a temperature lower than a temperature at which the receding contact angle on said recording medium starts to decrease;

heating means for heating the surface of said recording medium;

controlling means for controlling an amount of heat supplied from said heating means to the surface of said recording means in accordance with image information; and first supplying means, coupled to said recording medium, for supplying a contact material to the surface of said recording medium, said contact material being selected from a group comprising a liquid, a vapor and a solid which generates or changes to either a vapor or a liquid at a temperature lower than a temperature at which the receding contact angle on said recording medium starts to decrease, wherein the receding angle of a liquid adhesive area on the surface of said recording medium decreases, the liquid adhesive area being an area to which heat from said heating means is supplied in a condition where the contact material is in contact with the surface of said recording medium, so that a latent image corresponding to the liquid adhesive area is formed on the surface of said recording medium.

26. An apparatus as claimed in claim 25, wherein said heating means has a heater device driven by a driving pulse.

27. An apparatus as claimed in claim 26, wherein said control means has a means for controlling at least either a width or a level of the driving pulse in accordance with the image information.

28. An apparatus as claimed in claim 25, wherein said recording medium comprises a base member in which a heat conductivity in directions parallel to a surface of the base member is less than a heat conductivity in a direction perpendicular to the surface of the base member, and a recording layer formed on the surface of said base member, said recording layer having a characteristic in which the receding contact angle decreases when said recording medium is heated in a condition where said recording medium is in contact with a liquid, a vapor or a solid which generates or changes to either a vapor or a liquid at a temperature lower than a temperature at which the receding contact angle on said recording medium starts to decrease.

29. An apparatus as claimed in claim 28, wherein said base member comprises a poor conductive member having small heat conductivity and a plurality of good heat conductivity members each having a large conductivity which are provided in said poor conductive member, each of said good conductive members extending in a direction perpendicular to surface of said poor conductive member.

30. An apparatus as claimed in claim 29, wherein a size of each of said good conductive members in a direction parallel to the surface of said base member is equal to or less than a size of the liquid adhesive area which should be formed on said recording layer.

31. An apparatus as claimed in claim 28, wherein said base member comprises a good conductive member having a large heat conductivity.

32. An apparatus as claimed in claim 31, wherein said good conductive member having a heat conductivity greater than 0.01 cal/cm sec.°c.

33. An apparatus as claimed in claim 25 further comprising second supplying means, coupled to said recording medium, for supplying a recording agent which includes a colorant to the surface of said recording medium on which said latent image has been formed so that the recording agent adheres to the liquid adhesive area, an amount of recording agent adhering to the liquid adhesive area corresponding to an amount of heat supplied from said heating means to said recording medium, whereby a gradational visible image is formed on the surface of said recording medium.

34. An apparatus as claimed in claim 33 further comprising transferring means, coupled to said recording medium, for transferring the gradational visible image formed on the surface of said recording medium to another medium.

35. An apparatus for recording an image comprising:

a recording medium which has a surface having a characteristic in which a receding contact angle decreases when said recording medium is heated in a condition where said recording medium is in contact with a liquid, a vapor or a solid which generates or changes to either a vapor or a liquid at a temperature lower than a temperature at which the receding contact angle on said recording medium starts to decrease;

means for supplying said liquid, said vapor to said solid to said recording medium;

heating means for heating the surface of said recording medium;

controlling means for controlling an amount of heat supplied from said heating means to the surface of said recording means in accordance with image information; and supplying means, coupled to said recording medium, for supplying a recording agent which includes a colorant to the surface of said recording medium, wherein the receding contact angle of a liquid adhesive area decreases and the recording agent adheres to the liquid adhesive area, the liquid adhesive area being an area to which the heat from said heating means is supplied in a condition where the recording agent is in contact with the surface of said recording medium, an amount of the recording agent adhering to the liquid adhesive area corresponding to the heat supplied from said heating means to the surface of said recording medium, so that a gradational visible image is formed on the surface of said recording medium.

36. An apparatus as claimed in claim 35, wherein said heating means has a heater device driven by a driving pulse.

37. An apparatus as claimed in claim 36, wherein said controlling means has a means for controlling at least either a width or a level of the driving pulse in accordance with the image information.

38. An apparatus as claimed in claim 35, wherein said recording medium comprises a base member in which a heat conductivity in directions parallel to a surface of the base member is less than a heat conductivity in a direction perpendicular to the surface of the base member, and a recording layer formed on the surface of said base member, said recording layer having a characteristic in which the receding contact angle decreases when said recording medium is heated in a condition where said recording medium is in contact with a liquid, a vapor or a solid which generates or changes to either a vapor or a solid which generates or changes to either a vapor or a liquid at a temperature lower than a temperature at which the receding contact angle on said recording medium starts to decrease.

39. An apparatus as claimed in claim 38, wherein said base member comprises a poor conductive member having small heat conductivity and a plurality of good heat conductivity members each having a large conductivity which are provided in said poor conductive member, each of said good conductive members extending in a direction perpendicular to a surface of said poor conductive member.

40. An apparatus as claimed in claim 39, wherein a size of each of said good conductive members in a direction parallel to the surface of said base member is equal to or less than a size of the liquid adhesive area which should be formed on said recording layer.

41. An apparatus as claimed in claim 38, wherein said base member comprises a good conductive member having a large heat conductivity.

42. An apparatus as claimed in claim 41, wherein said good conductive member has a heat conductivity greater than 0.01 cal/cm sec.°c.

43. An apparatus for recording an image comprising:

a recording medium which has a surface having a characteristic in which a receding contact angle decreases when said recording medium is heated in a condition where said recording medium is in contact with a liquid, a vapor or a solid which generates or changes to either a vapor or a liquid at a temperature lower than a temperature at which the receding contact angle on said recording medium starts to decrease;

heating means for heating the surface of said recording medium;

controlling means for controlling a size of an area to which said heating means supplies heat in accordance with image information; and first supplying means, coupled to said recording medium, for supplying a contact material to the surface of said recording medium, said contact material being selected from a group comprising a liquid, a vapor and a solid which generates or changes to either a vapor or a liquid at a temperature lower than a temperature at which the receding contact angle on said recording medium starts to decrease, wherein the receding angle of a liquid adhesive area on the surface of said recording medium decreases, the liquid adhesive area being the area to which the heat from said heating means is supplied in a condition where the contact material is in contact with the surface of said recording medium, so that a latent image corresponding to the liquid adhesive area is formed on the surface of said recording medium.

44. An apparatus as claimed in claim 43 further comprising second supplying means, coupled to said recording medium, for supplying a recording agent which includes a colorant to the surface of said recording medium on which said latent image has been formed so that the recording agent adheres to the liquid adhesive area, an amount of recording agent adhering to the liquid adhesive area corresponding to the size of the liquid adhesive area to which said heating means supplies the heat, whereby a gradational visible image is formed on the surface of said recording medium.

45. An apparatus for recording an image comprising:

a recording medium which has a surface having a characteristic in which a receding contact angle decreases when said recording medium is heated in a condition where said recording medium is in contact with a liquid, a vapor or a solid which generates or changes to either a vapor or a liquid at a temperature lower than a temperature at which the receding contact angle on said recording medium starts to decrease;

means for supplying said liquid, said vapor or said solid to said recording medium;

heating means for heating the surface of said recording medium;

controlling means for controlling a size of an area to which said heating means supplies heat in accordance with image information; and supplying means, coupled to said recording medium, for supplying a recording agent which includes a colorant to the surface of said recording medium, wherein the receding contact angle of a liquid adhesive area decreases and the recording agent adheres to the liquid adhesive area, the liquid adhesive area being an area to which the heat from said heating means is supplied in a condition where the recording agent is in contact with the surface of said recording medium, an amount of the recording agent adhering to the liquid adhesive area corresponding to a size of the liquid adhesive area to which said heating means supplies the heat, so that a gradational visible image is formed on the surface of said recording medium.

* * * * *